US011840836B2

(12) United States Patent
Ohanesian

(10) Patent No.: US 11,840,836 B2
(45) Date of Patent: Dec. 12, 2023

(54) STRUCTURAL WALL PANEL SYSTEM

(71) Applicant: Viken Ohanesian, San Juan Capistrano, CA (US)

(72) Inventor: Viken Ohanesian, San Juan Capistrano, CA (US)

( * ) Notice: Subject to any disclaimer, the term of this patent is extended or adjusted under 35 U.S.C. 154(b) by 0 days.

(21) Appl. No.: 16/938,490

(22) Filed: Jul. 24, 2020

(65) Prior Publication Data

US 2021/0025163 A1 Jan. 28, 2021

Related U.S. Application Data

(60) Provisional application No. 62/878,934, filed on Jul. 26, 2019.

(51) Int. Cl.

| | |
|---|---|
| ***E04B 2/76*** | (2006.01) |
| ***E04B 2/64*** | (2006.01) |
| ***E04B 2/02*** | (2006.01) |
| ***E04B 2/74*** | (2006.01) |

(52) U.S. Cl.

CPC ..... *E04B 2/76* (2013.01); *E04B 2/02* (2013.01); *E04B 2/64* (2013.01); *E04B 2002/7461* (2013.01)

(58) Field of Classification Search

CPC ..... E04B 2/76; E04B 2/64; E04B 2/02; E04B 2002/7461; E04B 7/045; E04B 1/6183; E04B 1/08; E04D 3/358; E04D 3/351; E04D 3/361; E04D 3/365; E04D 3/36; E04C 2/526; E04C 2/288

See application file for complete search history.

(56) References Cited

U.S. PATENT DOCUMENTS

| | | | | |
|---|---|---|---|---|
| 4,633,634 A * | 1/1987 | Nemmer | E04B 2/62 | 52/275 |
| 4,914,883 A * | 4/1990 | Wencley | E04C 2/384 | 156/79 |
| 5,297,369 A * | 3/1994 | Dickinson | E04B 2/7411 | 52/145 |
| 6,235,367 B1 * | 5/2001 | Holmes | E04B 1/14 | 428/223 |
| 2005/0055973 A1 * | 3/2005 | Hagen | B29C 44/18 | 52/741.1 |

(Continued)

*Primary Examiner* — Brian D Mattei
*Assistant Examiner* — Omar F Hijaz
(74) *Attorney, Agent, or Firm* — Myers Andras Ashman Bisol LLP; Joseph C. Andras

(57) ABSTRACT

A structural panel system formed from a substrate (such as cement board or paper) and structural metal studs (such as lightweight galvanized steel members), where the metal studs are embedded within an insulating core that is formed onto the substrate, where the metal studs are gapped from the inner surface of the substrate to prevent thermal energy from transferring from the substrate to the metal stud or vice versa. In addition, parallel assembly slots may be formed in the gap at the top and bottom ends of each panel assembly to provide connective access to the top and bottom ends of the metal studs for structural connection to the foundation at the bottom or other overhead structure at the top via connective components. The connective components include a bottom U-channel member and a top U-channel member that are configured to fit into the parallel assembly slots.

21 Claims, 22 Drawing Sheets

(56) References Cited

U.S. PATENT DOCUMENTS

| | | | | |
|---|---|---|---|---|
| 2008/0104913 | A1* | 5/2008 | Messenger | E04C 2/384 52/309.9 |
| 2012/0216476 | A1* | 8/2012 | Naidoo | B32B 27/40 52/794.1 |
| 2012/0231231 | A1* | 9/2012 | Curtin | E04C 2/292 428/192 |
| 2013/0067838 | A1* | 3/2013 | Black | E04B 1/14 52/220.7 |
| 2014/0259970 | A1* | 9/2014 | Shapiro | E04B 1/7629 52/27 |
| 2015/0176274 | A1* | 6/2015 | James | E04C 2/384 52/696 |
| 2018/0073797 | A1* | 3/2018 | Taqi | F25D 23/087 |
| 2018/0195282 | A1* | 7/2018 | Pilz | E04B 2/02 |
| 2021/0040735 | A1* | 2/2021 | Hasegawa | E04B 2/7457 |

* cited by examiner

PLAN VIEW

WITH CORE 70 REMOVED TO SHOW STRUCTURAL MEMBERS 90

Panel joint

CONNECTION AT THE BASE

CONNECTION AT THE BASE

CONNECTION AT THE BASE

CONNECTION AT THE TOP

CONNECTION AT THE TOP

CONNECTION AT THE TOP

ROOF DETAIL

ROOF DETAIL

WALL PANEL WITH SINGLE SIDE OFFSET

ALTERNATIVE BOTTOM BRACKET

STRUCTURAL WALL PANEL SYSTEM

This application claims the benefit of provisional patent application No. 62/878,934, filed Jul. 26, 2019, now pending, the entire contents of which are hereby incorporated by reference.

BACKGROUND

Field of the Invention

The present invention relates generally to a structural wall panel system and, more particularly, to a structural wall panel system made up of fully- or partially-finished panel assemblies that are comprised of a core of filling material that is covered on at least one side with a cladding material (e.g. cement board, gypsum board, paper, foil, etc.), where structural members (e.g. lightweight galvanized steel members) are embedded within the core and spaced or gapped or "floated" away from at least one face of the core in order to form gaps that separate the cladding material from the structural members and reduce thermal conductivity through the panel assembly, and where the top and bottom ends of the structural members may be connectively accessible via parallel assembly slots that are formed in the gaps at the top and bottom ends of each panel assembly for structural connection to other system components.

Description of the Related Art

There are generally two types of walls: (1) bearing walls; and (2) partitioning walls. A bearing wall carries the weight of building components pressing down on the wall from above, all the way down to the foundation. Such a wall is sometimes known as a "load-bearing" wall because the weight transferred down to the foundation is called the "load." Other names for a bearing wall are a structural wall or supporting wall. The typical building components supported by a bearing wall include the roof and, if present, the floor and walls of an intervening story.

Exterior walls almost always function as bearing walls and interior walls sometimes function as bearing walls. In a multi-story building, the interior bearing walls are usually directly over one another on each floor because the weight is transferred straight down, through the bearing walls, from one level of the building to the next.

A partitioning wall is an interior wall that divides an interior space without bearing any significant load from above, i.e. without passing any substantial weight from other structure downward toward the foundation.

A structural wall panel system according to the present invention is a quick-to-assemble, cost-effective replacement for conventional wood framed construction, i.e. stud-framed walls which are made from vertical wood members called "studs" which are assembled with nails in a parallel spaced arrangement between horizontal wood members called top and bottom plates. Because they use many separate pieces of wood, stud-framed walls are sometimes called "stick walls." The vertical studs are usually 2"×4" in nominal size and are generally spaced from one another at an on-center spacing distance of 16" or 24". After the overall frame is constructed, it is clad with dry sheeting on both sides of the framing. The interior walls are often formed from a single layer of gypsum board. The exterior walls may be covered with a wide variety of materials, depending on climate and local practices, e.g. plywood, oriented strand board (OSB) sheathing, cement-board, etc., a vapor barrier, and decorative materials.

Light gauge steel construction is similar to wood framed construction in many respects, but instead of wooden framing members it uses thin steel sections that are usually sized to roughly correspond to conventional wood members. The thin steel sections are connected with self-tapping screws rather than nails. A building frame with light gauge steel members is similarly clad with drywall, plywood, etc.

The labor for wood frame construction or light gauge steel construction is relatively expensive because it requires significant skill and takes a relatively long time to assemble the framing, in the field, according to the designer's plans. In many cases, it would be better if the intended buildings could be designed in advance and then assembled with modular pre-assembled wall panels that already have one or both sides covered with the desired cladding material. However, many of the wall panel systems known to the inventor are intended for interior, non-supporting use (e.g. for use as the walls of trade show booths, or for interior office walls that have a non-structural interface with a suspended ceiling or drop ceiling), and generally do not provide a structural, load-bearing construction.

At the same time, the structural wall panel systems known to the inventor are heavy, overly complicated, require significant onsite labor to finish or are poorly insulated. For example, some systems use oriented strand board on both sides of each panel, making them quite heavy and still very labor intensive to add cladding, vapor barriers and other finishing works. Another system known to the inventor is marketed by Thermasteel. This system uses lightweight metal frames around the edges and across the faces on either side of an expanded polystyrene (EPS) core, somewhat like an exoskeleton, so the metal is exposed directly to the panel's exterior while still not addressing the application of interior and exterior surfaces.

A problem exists, therefore, in that the conventional framing techniques are costly and the panel systems known to the inventor are heavy, overly complicated, non-structural, with unfinished surfaces or poorly insulated. There remains a need, therefore, for a structural wall panel system comprised of improved wall panels where lightweight galvanized steel members are embedded within an insulating core, but connectively accessible via parallel assembly slots at the top and bottom ends of the wall panel for structural connection to other system components, and spaced from the inner and outer surfaces of the insulating core in order to allow the exterior and interior surface cladding material to be bonded to the insulating core delivering a finished structural wall panel that can be quickly assembled together while reducing thermal conductivity through the panel. The assembly slots at the top and bottom of the wall panel can also be opened perpendicular to or other orientation relative to the metal studs to allow for additional internal metal bracings (i.e. earthquake bracings) to connect with the metal studs and make a structural connection.

SUMMARY OF THE INVENTION

The present invention provides structures and methods which overcome the deficiencies in the prior art.

In a first aspect, the invention resides in a structural panel assembly of rectangular parallelepiped shape that is substantially taller and wider than thick, the structural panel assembly having a first broad side, a second broad side, a bottom end, a top end, a left end, and a right end, the structural panel assembly adapted for use in a structural panel building system, the structural panel assembly comprising: a substrate of sheet material forming the first broad side of the structural panel assembly, the substrate having an inner face and an outer face; at least one metal stud having an elongated configuration, the at least one metal stud extending between the bottom and top ends of the structural panel assembly, positioned in parallel with the substrate, and located adjacent to but spaced from the inner face of the substrate to form a gap between the inner face of the substrate and the at least one metal stud to prevent the inner surface of the substrate from making thermal contact with the at least one metal stud and thereby provide the structural panel assembly with increased thermal insulation capability; and a filling material, the at least one metal stud being embedded in the filling material, the filling material making contact with the inner face of the substrate and the at least one metal stud to hold together the substrate, the at least one metal stud, and the filling material.

In a preferred embodiment, the structural panel assembly comprises a plurality of shims that create the gap between the substrate and the at least one metal stud, the shims being positioned on the inner surface of the substrate, beneath the at least one metal stud.

And, in other embodiments, the structural panel assembly further comprises at least one bottom mounting slot formed in the gap between the substrate and the at least one metal stud at the bottom end of the structural panel assembly and at least one top mounting slot formed in the gap between the substrate and the at least one metal stud at the top end of the structural panel assembly, the bottom and top mounting slots exposing a bottom and top end, respectively, of the at least one metal stud for structural connection of the bottom and top ends of the structural panel assembly.

Preferably, there are a pair of mounting slots at the bottom and a pair of mounting slots at the top, and in such case, the structural panel assemblies further comprise a plurality of blind apertures formed in the first broad side and the second broad side of the structural panel assembly, near the top and bottom ends of the structural panel assembly, respectively, the blind holes adapted to permit mechanical fasteners to be inserted through the first and second extensions of the U-channel member and then into the opposite sides of the at least one metal stud to securely connect the first and second extensions of the U-channel member to the at least one metal stud.

BRIEF DESCRIPTION OF THE DRAWINGS

The just summarized invention is best understood with referenced to the drawings of which:

FIGS. 7 and 8 are closeup views of the top and bottom ends 30, 20, respectively, of the structural panel assembly 10 shown in FIG. 6;

FIG. 12 is a cross-sectional closeup of a structural panel assembly 10 being lowered into a bottom U-channel 210 which shows how the structural member 90 is uniquely gapped from the substrate 60 and, in this case, also from the additional cladding layer 160, in order to more fully allow the material forming the core 70 to occupy the gap between the member 90 and the exterior surface materials (e.g. substrate 60 and cladding layer 160), and which also shows how the vertical walls 212 of the bottom U-channel 210 interfaces with the structural members 90 via elongated mounting slots 22 formed in the gaps between the structural members 90 and the substrate 60 and, if present, additional cladding layer 160; FIG. 12 also shows how threaded fasteners 24 may be inserted into blind apertures 21 to directly connect the structural panel assembly's structural member 90 to the bottom-connecting U-channel 210; and FIG. 13 shows the structural panel assembly 10 structurally connected to the slab 200 with the fasteners 220 interconnecting the bottom U-channel 210 to the structural member 90;

FIG. 14 shows an angled top channel 310 mounted to the structural panel 10 for use in connecting together adjacent structural panels 10, 10, and supporting a roof panel; FIGS. 15 and 16 show how an angled top channel 310 is dropped into the elongated mounting slots 32 at the top end 30 of the structural panel 10 for supporting additional structure above the structural panel assembly 10; FIG. 17 shows the additional structure as roof panel; and FIG. 18 shows in cross section how the roof panel is connected to the angled top channel 310 with a fastener 320;

DETAILED DESCRIPTION OF THE PREFERRED EMBODIMENTS

Applicant's preferred embodiment is best understood by starting from a more distant view and then coming in closer to understand its details. In other words, start first with a view of the forest and then come closer and view the trees.

Figure 1:
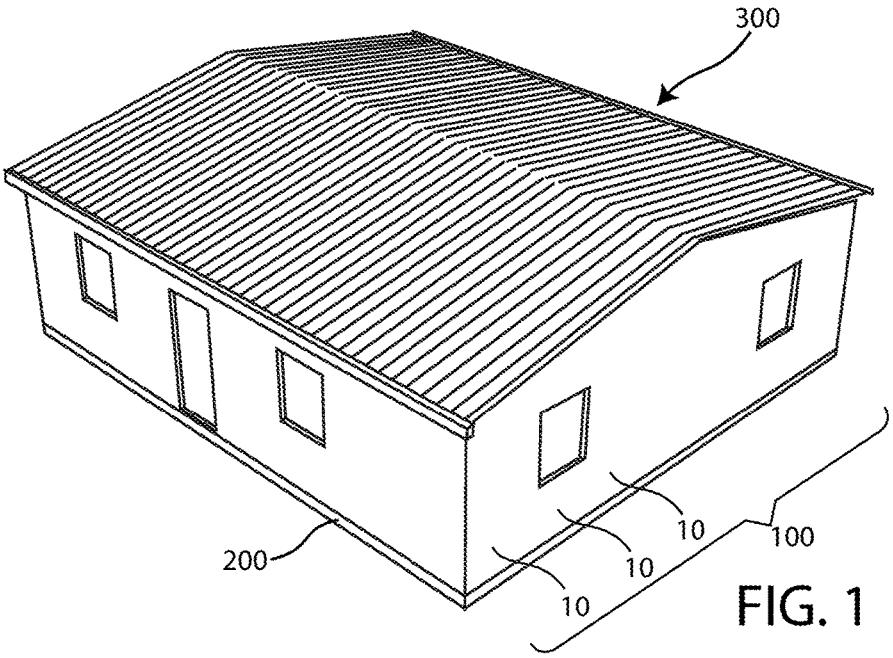
FIG. 1 shows a structure 300 assembled onto an exemplary slab or foundation 200 using a structural panel system 100 comprised of applicant's presently preferred structural panel assemblies 10 as shown in more detail below.

FIG. 1 shows an exemplary goal of applicant's presently preferred wall panel system 100 (described more fully below), namely starting with a level concrete foundation 200 and then erecting a structure 300 on that foundation 200.

Figure 2:
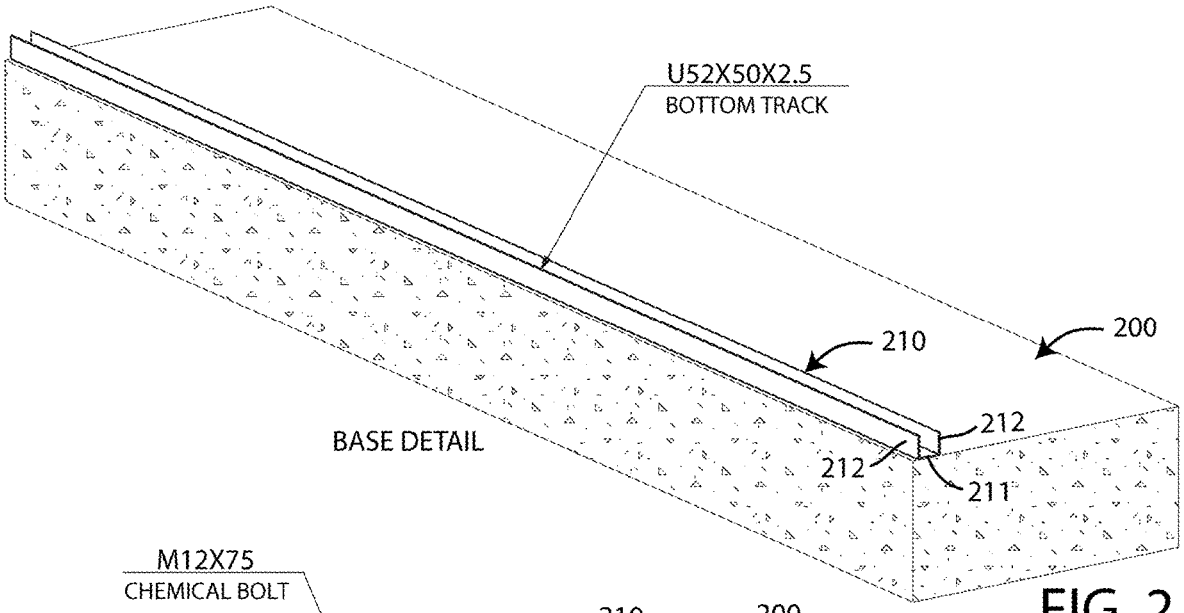
FIGS. 2 and 3 show a first step in the assembly process or first part of the overall system which involves securing a bottom track or "bottom-connecting U-channel" 210 to the foundation 200.
Figure 3:
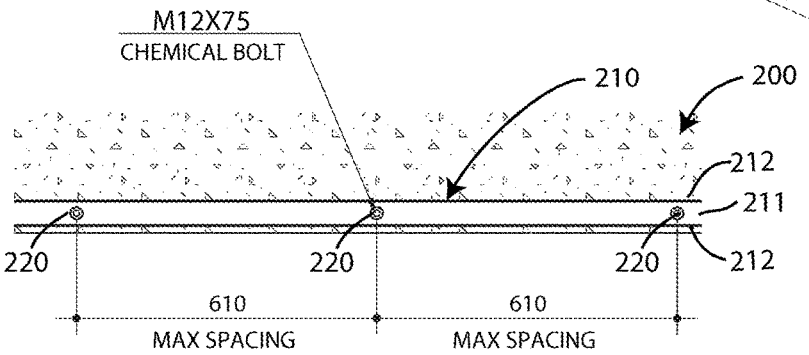

FIGS. 2 and 3 show a first step in the assembly process which involves securing a bottom track or "bottom-connecting U-channel" 210 to the foundation 200 with suitable fasteners 220. As explained further below, the bottom-connecting U-channel 210 will be used to structurally connect adjacent walls together. In the preferred assembly, chemical bolts hold the bottom track 210 to the foundation with corresponding nuts and washers (not separately numbered). The bottom-connecting U-channel 210 can be a conventional GI ("galvanized iron") member of suitable size and thickness. As shown, the bottom-connecting U-channel 210 has a U-shaped profile that is formed from a flat bottom wall 211, and two vertical side walls 212, 212.

Wall Panel Assemblies Generally

As described below and shown throughout the figures, applicant's embodiments are centered around a unique wall panel assembly 10, or just wall panel, that generally comprises a substrate 60 (e.g. cement board, plank-style cement board, gypsum board, etc.), an insulated core 70 which is viscous until cured, provides glue-like properties during manufacture, and provides insulating properties when cured, and an optional second covering layer 160 (e.g. gypsum board, pre-textured panels, metal sheet, etc.) or other surface material (e.g. paper such as butcher paper, foil, rolled steel, etc.) which, if used, may be added during manufacture or later onsite. Moreover, at least two structural members 90 which are embedded in the core 70 and strategically gapped from the substrate 60, the optional second covering layer 160, or both.

Preferred Wall Panels—Cement Board Substrate with Gypsum Board

Figure 4:
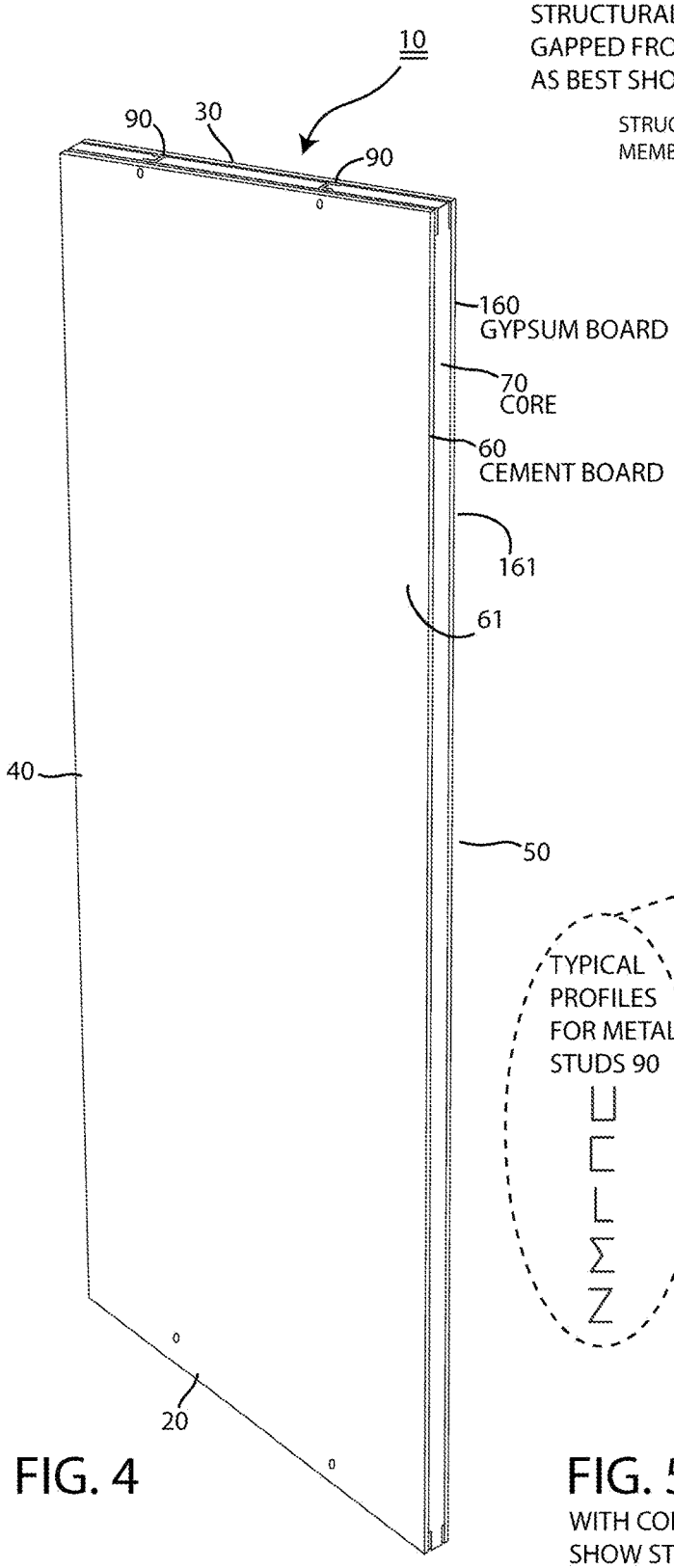
FIG. 4 shows a presently preferred structural panel assembly 10 having a substrate 60, filling material or core 70, structural members 90 located adjacent to the substrate 60 and, in this case, an additional factory-installed cladding layer 160 (e.g. gypsum board)

FIG. 4 shows a presently preferred wall panel assembly 10 that comprises a substrate 60 (cement board), an insulated core 70 which was formed onto the substrate 60 during manufacture and an additional core covering layer 160 (gypsum board) which was also added during manufacture. It also has a bottom end 20, a top end 30, a first side end 40, and a second side end 50.

The substrate 60 defines an outer face 61 and the additional covering layer 160 defines an outer face 161. Generally speaking, if the substrate 60 is a cement board then the wall 10 would be installed with the substrate 60 facing the exterior, and if the substrate 60 were gypsum board then the wall 10 would be installed with the substrate 60 facing the interior (and with some other material, e.g. metal, facing the exterior). In FIG. 4, the substrate 60 is cement board so the wall would be installed with the cement board substrate 60 on the exterior and the gypsum board panel serving as a covering layer 160 on the interior.

The preferred core 70 is formed from a thermally insulating material that when not yet cured has glue like characteristic to encase the structural members 90 and to bond the interior and exterior surface materials (e.g. substrate 60 and, if used, additional covering layer 160) to the core 70 which encases the structural members. The presently preferred core 70 comprises foamed polyurethane, but other insulating materials such as expanded polystyrene (EPS) or foamed polyisocyanurate (PIR) may be used.

The preferred wall panel 10 further comprises at least one structural load-bearing member 90 that is embedded within the core 70 during manufacture—typically metal studs. In this preferred panel 10, the two load-bearing members 90 comprise C-shaped studs formed from lightweight galvanized steel (LGS), sometimes called LGS studs. As shown by the broken lines, in addition to a C- or U- shaped profile, the metal stud 90 can have other suitable profiles such as an L-shaped, Sigma-shaped, or Z-shaped profile. There can also be a stud on each end and one in the center for a total of three or even four studs, along with horizontal connecting steel members that enhance the structural integrity of the vertical studs. Additionally, for stronger structural panels that resist lateral or shear movement, there can be horizontal or diagonal cross members offset from the surface as with the placement of the vertical studs. Similarly, for headers on top of doors and windows that require greater support, diagonal LGS members may be used between studs. Finally, for additional support for a second floor deck, a panel with an internal truss like cross member bracing design can be used.

The material used to form the core 70 has glue like characteristics to allow the surface cladding, including at least substrate 60, to securely bond to one or both surfaces of the core 70 during the manufacturing process. Referring again to FIG. 4, the wall panel 10 can be manufactured so that the side of the core 70 opposite to the substrate 60 (right here) is exposed, or unclad, and further finished in the field. Alternatively, and perhaps more frequently, the side of the core 70 that is opposite to the substrate 60 would leave the factory "pre-clad" with another cladding layer 160 that, like the substrate 60, is already bonded to that side of the wall panel 10 as well (e.g. gypsum board, paper, foil, sheet metal, rolled steel, plank-style cement board, pre-textured panels, etc.). A likely configuration, for example, would use a substrate 60 formed of cement board (which would ultimately face the structure's exterior), and an opposite side cladding layer 160 consisting of gypsum board (which would ultimately face the structure's interior). Alternatively, the substrate 60 could be formed from gypsum board and the opposite side could be covered with rolled steel that is simultaneously processed to have depressions to add rigidity and simulate a planked look.

Figure 5:
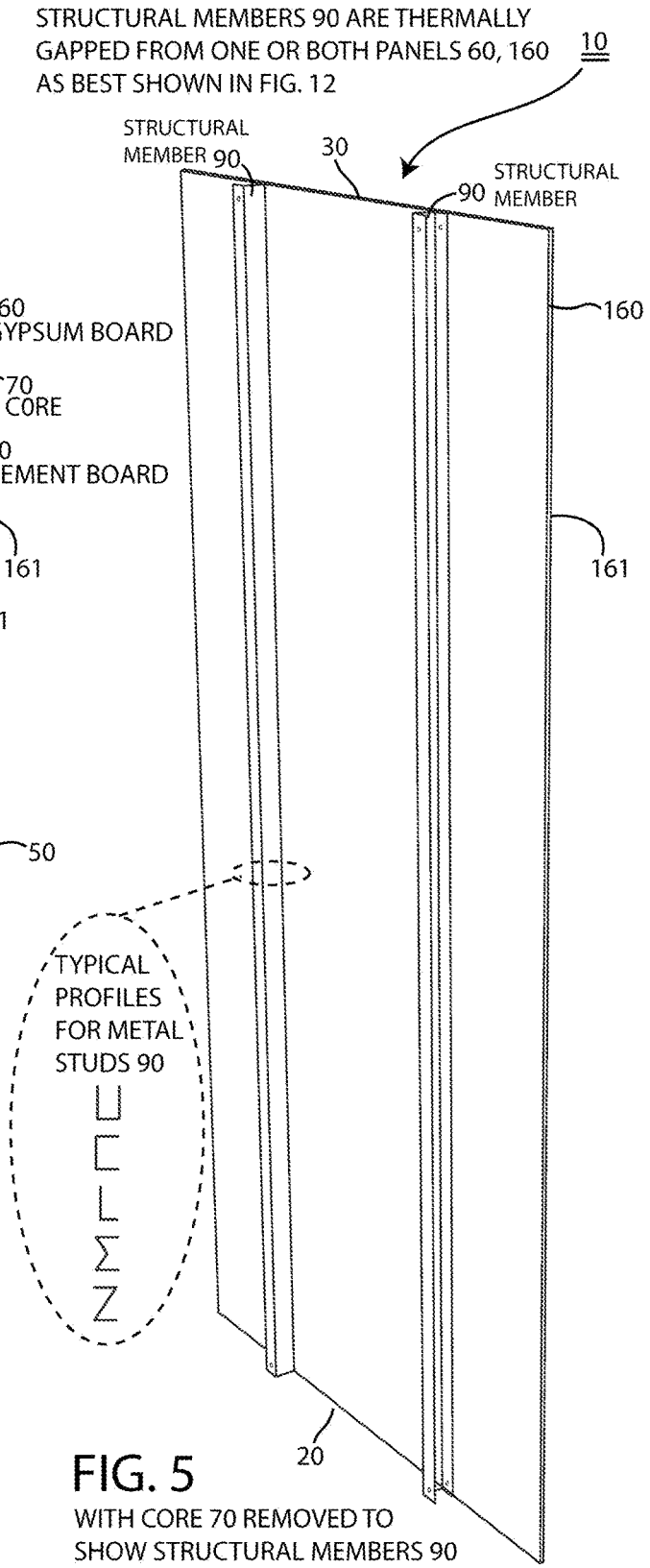
FIG. 5 shows the structural panel assembly 10 from FIG. 4, but with the substrate 60 and core 70 removed to show how each structural member 90 extends from the top end 30 to the bottom end 20 of the structural panel assembly 10 so that it can be structurally connected to other system elements.

FIG. 5 is comparable to FIG. 4 but the substrate 60 and core 70 have been removed to clarify that each structural member 90 extends from the top end 30 to the bottom end 20 of the wall panel 10 so that it can be structurally connected to other system elements (e.g. bottom track 210) and thereby transfer the load of overhead weight downward through the wall panel 10.

The structural member 90 is transversely oriented relative to the substrate 60, somewhat akin to the orientation of a wood or metal stud in a building frame. However, as best shown in cross-section in FIG. 12, the member 90 is uniquely spaced gapped from the substrate 60 and, in this case, also from the additional cladding layer 160, in order to form gaps 91 which collectively refers to first gap 91*a* between the structural member 90 and the cement board 60 and second gap 91*b* between the structural member 90 and the gypsum board 160 that more fully allow the material forming the core 70 to occupy the gap 91*a* between the member 90 and the exterior surface material (e.g. substrate 60 and cladding layer 160) to securely bond them to the glue like core while breaking the thermal bridge that would otherwise inefficiently transmit thermal energy through the wall panel 10 via the structural member 90, i.e. the cement board 60 and gypsum board 160 are glued to the polyurethane core 70 while eliminating the movement of heat from the interior outwardly to the colder outside, or move heat from outside inwardly into a cooler, air-conditioned interior. The gap should exist along substantially the entire length of the member 90. The width of the gap 91 can vary from a minimum of about 1/32" (enough to ensure that contact is minimal or nonexistent) to about 3" (a practical maximum).

In some sense, the studs 90 become floating studs relative to the substrate 60, the additional cladding layer 160, or both. The floating studs inside the wall allowing for the nearly complete bonding of the surface materials within the thermal gaps 91 which are created by placing a plurality of small spacers or shims 93 (see e.g. FIG. 9E) on the substrate 60 to hold the structural member 90 slightly above the substrate 60 before injecting or spraying the insulating material that forms the core 70 onto, around, and above the structural member 90. These floating studs can be offset from the outer surface by as little as 0.5 mm. Primarily this offset allows for the connection of the top and bottom U channels connecting the walls and an insulating gap from the outer and inner surfaces. When the wall 10 features a substrate 60 along with a pre-applied cladding layer 160 on the opposite side, as in FIG. 4, this provides for prefinished wall panels that are ready to just connect together with no further exterior or interior surface cladding in a fast assembly wall finished panel system.

Figures 6, 7, 8:
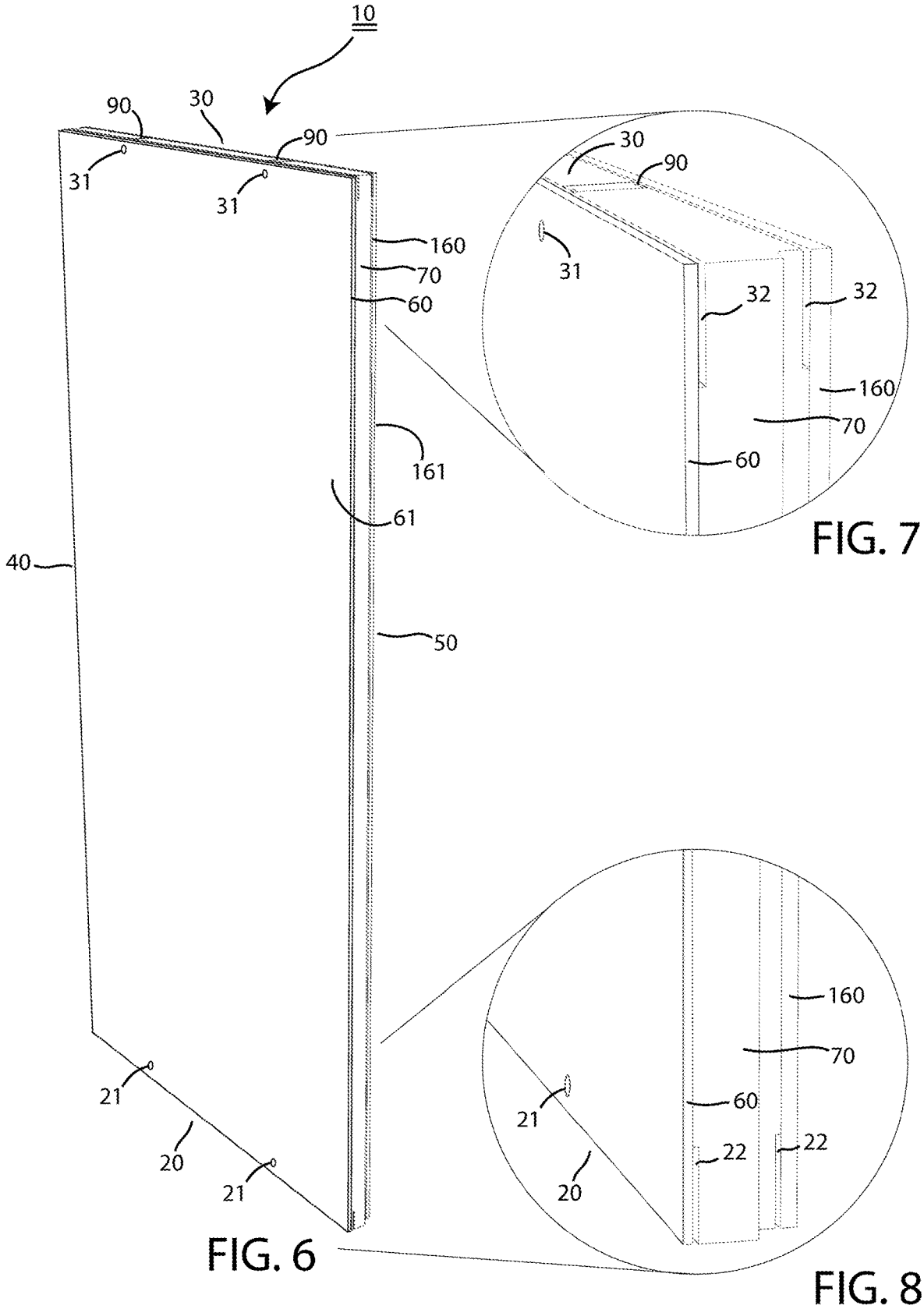
FIGS. 6, 7 and 8 show the detailed construction of the preferred structural panel assembly 10 which was introduced in FIGS. 4 and 5. In particular.

FIGS. 6, 7, and 8 are provided to more clearly show the detailed construction of the preferred wall panel assembly 10 which was introduced in FIGS. 4 and 5. In particular, FIGS. 7 and 8 are closeup views of the top and bottom ends 30, 20, respectively, of the wall panel assembly 10 in FIG. 6. As shown, the preferred wall panel assembly 10 features elongated mounting slots 22 at the bottom 20 and elongated mounting slots 32 at the top 30. The elongated mounting slots 22, 32 are preferably created in the wall panels at the time of manufacture, i.e. by using a circular saw and a fence to guide the blade so that it cuts the elongated mounting slots 22, 32, right next to the structural members 90. When present, the previously mentioned "gaps" 91 provide a convenient location for creating the top and bottom mounting slots 22, 32.

FIGS. 6, 7, and 8 also show apertures 21, 31 which are preferably pre-formed at the time of manufacture to provide access for the purposes of onsite assembly to the structural members 90 through the substrate 60 (or opposing cladding layer 160) and the core 70. This allows for a metal to metal connection between the metal studs in the wall and the metal framing around the walls to mechanically provide for a structural load bearing connection. The gap between the metal studs and the exterior surfaces which can be as little as 0.5 mm also allows for metal straps, braces and other connectors, commonly used in earthquake prone regions, to go into the panels from the foundation of a house without breaking the exterior surface barrier. Screws are used to attach the foundation metal straps or braces to the metal studs in the panels in the similar ways as the U-channel 210 connects to the studs 90.

FIGS. 9A, 9B, 9C, and 9D are provided to show the presently preferred method of further interconnecting the wall panels 10. Here, each wall panel 10 has a substrate 60 that is formed from cement board and an opposite side cladding layer 160 that is formed from gypsum board. When installed on site, as shown below, the cement board substrate 60 would face the exterior of the structure and the gypsum board cladding layer 160 would face the interior of the structure.

Figure 9D:
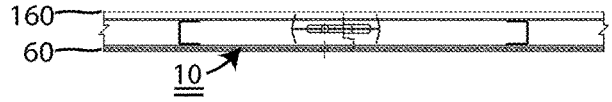
FIGS. 9A, 9B, 9C, and 9D show the presently preferred structure of male and female cam-locks and related method of interconnecting the structural panel assemblies 10 to adjacent structural panel assemblies with the cam-locks.
Figure 9C:
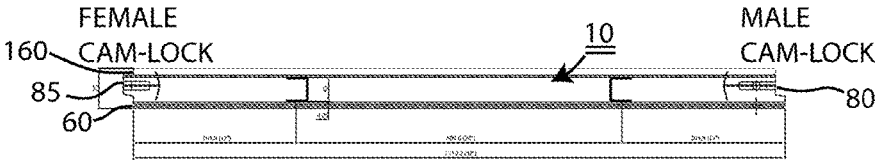
Figure 9A:
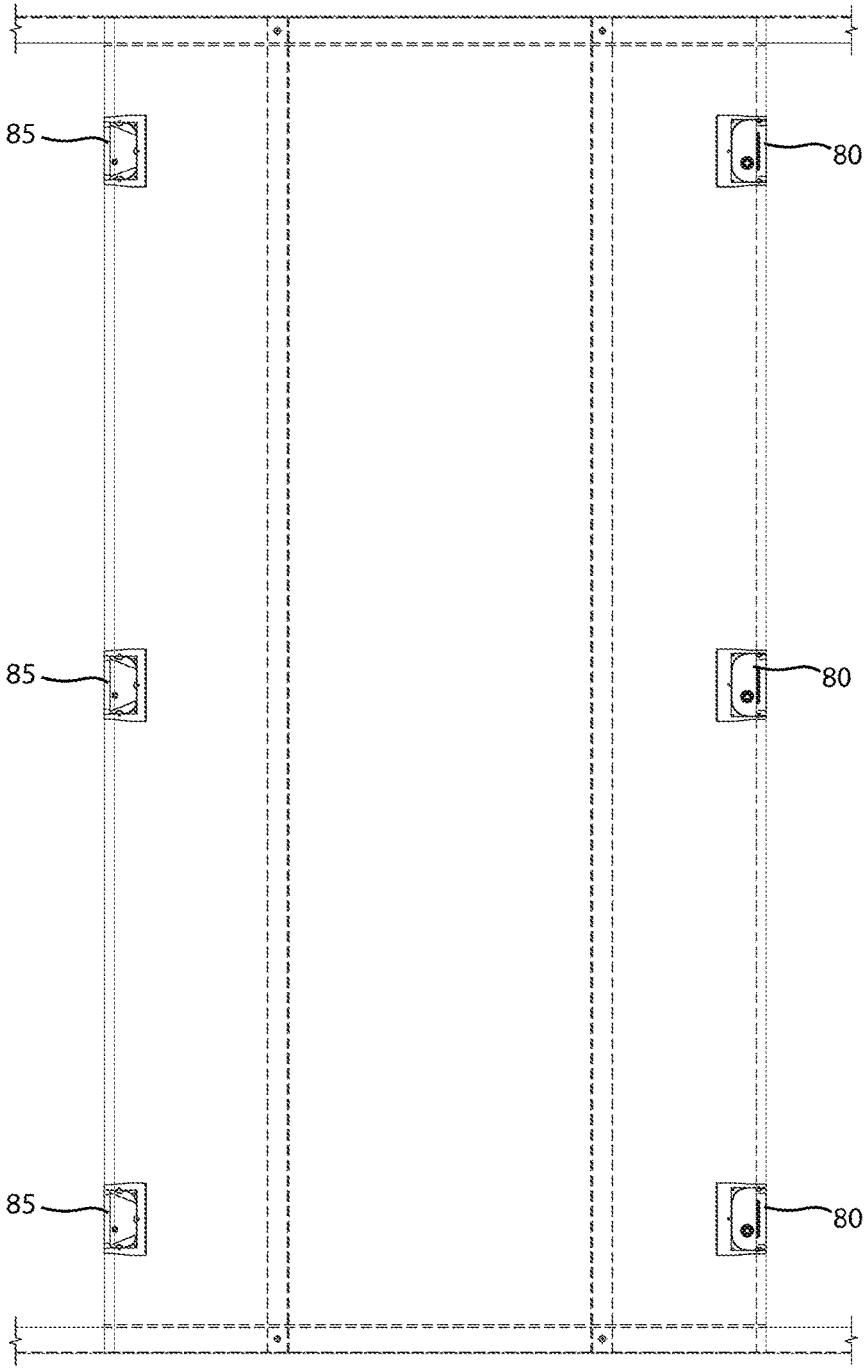
Figure 9B:
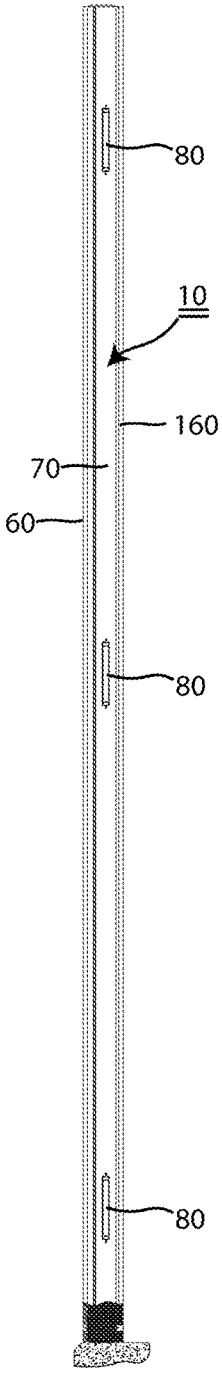

As shown, the preferred method of connecting adjacent wall panels 10 to each other is based on the top and bottom U-channels 210, 310 discussed above and shown in FIGS. 2 and 3 (bottom only) and discussed below and shown in FIGS. 10 and 12-17 (top and bottom). As shown in FIGS. 9A, 9B, 9C, and 9D, however, each preferred wall panel 10 further features a set of male cam-locks 80 on one end and a corresponding set of female cam-locks 85 on an opposite end. When two walls are brought together as shown in FIG. 9D, the male and female cam-locks 80, 85 are interlocked to form a firm panel joint. Panels can use one, two, three, or more sets of camlocks according to height. Other methods of interlocking the panels 10 may be used.

Figure 9E:
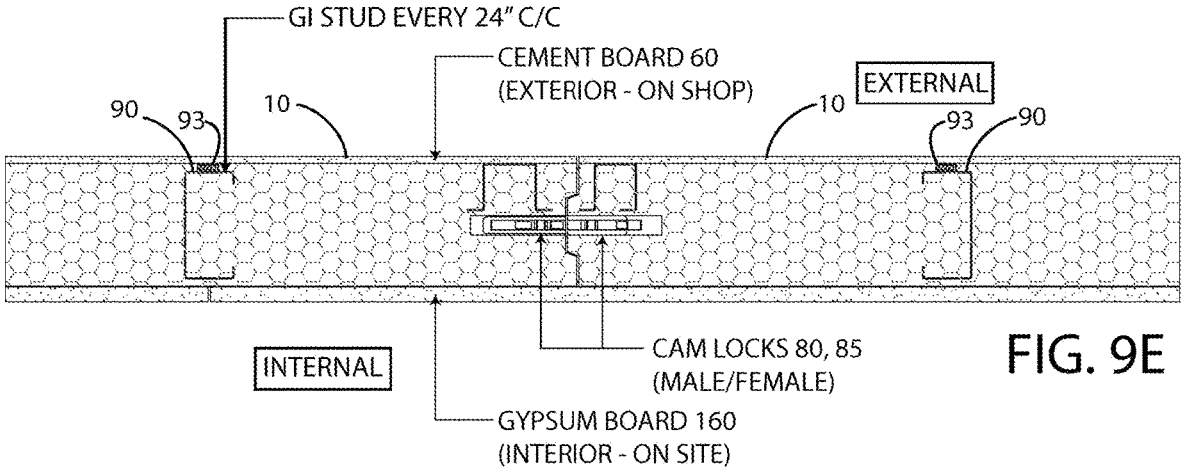
FIGS. 9E and 9F show how the cam locks secure one structural panel assembly to another structural panel assembly.
Figure 9F:
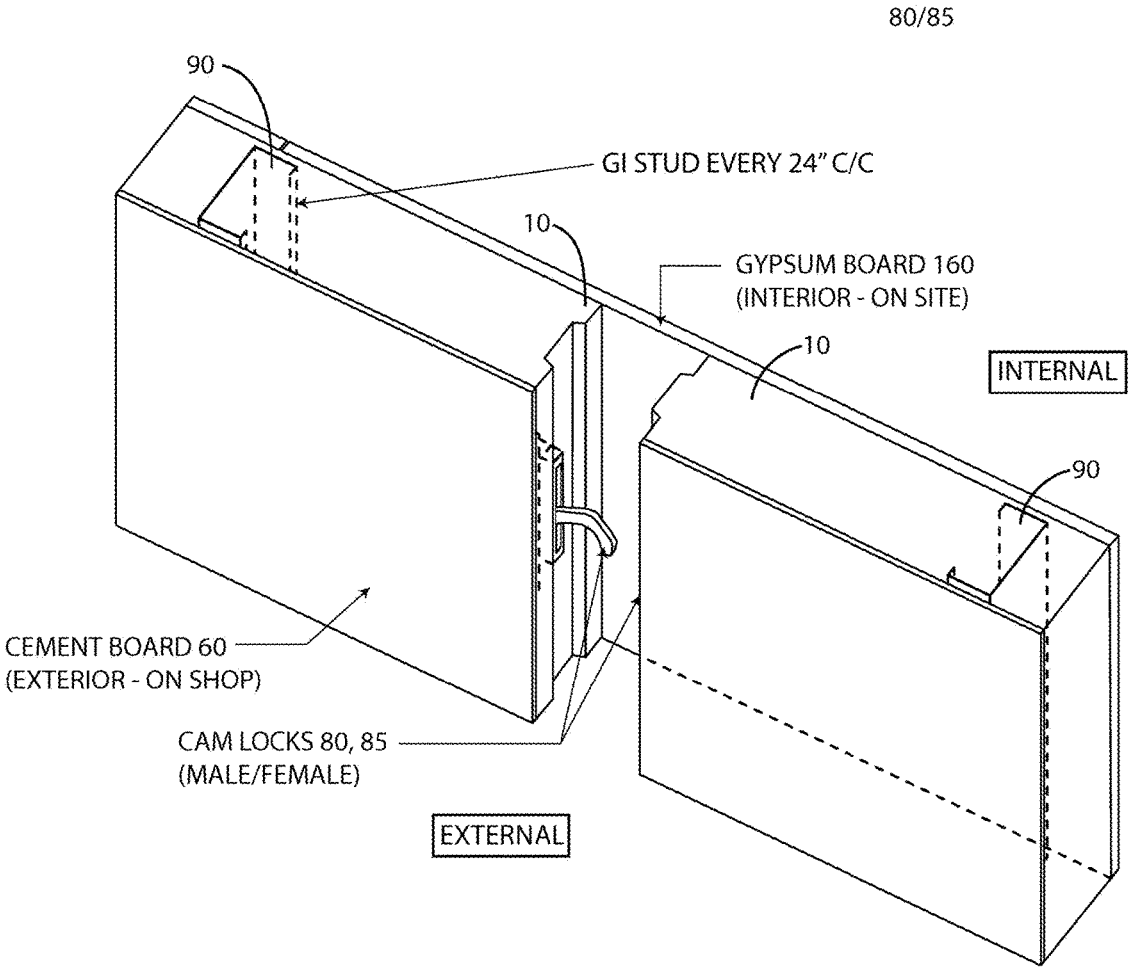

FIGS. 9E and 9F are schematic 3D cross-sections of the adjoining portions of two adjacent panel assemblies that show how the cam locks 80/85 secure one wall panel assembly 10 to another wall panel assembly 10. The illustrated section is taken mid-panel such that the elongated mounting slots 32 are not visible. Here the LGS studs 90 are spaced from the left and right ends where the cam locks 80/85 are located (usually two studs 90 per wall panel assembly 10). In order to provide increased strength as may be needed for example in a two-story construction, another embodiment is contemplated where each wall panel assembly 10 has three or more studs with two of those studs located at or very near the left and right ends where the cam locks 80/85 are located.

Figure 11:
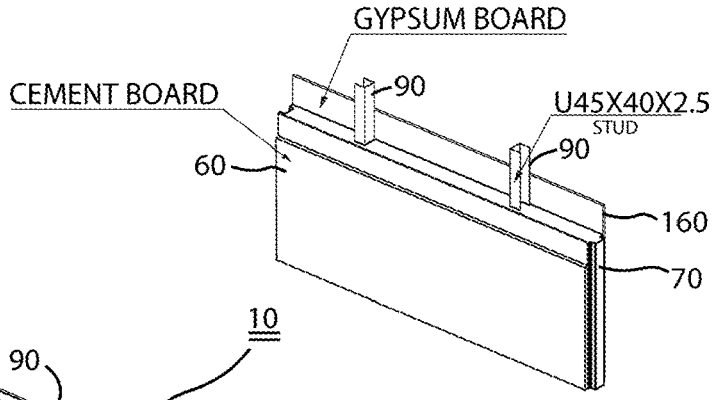
FIG. 11 is a closeup of the top end of the structural panel assembly 10 with an upper portion of the substrate 60 and some of the core 70 removed to show how the structural members 90 extend through the core 70 in parallel with the substrate 60 and, in this particular case, additional cladding layer 160
Figure 10:
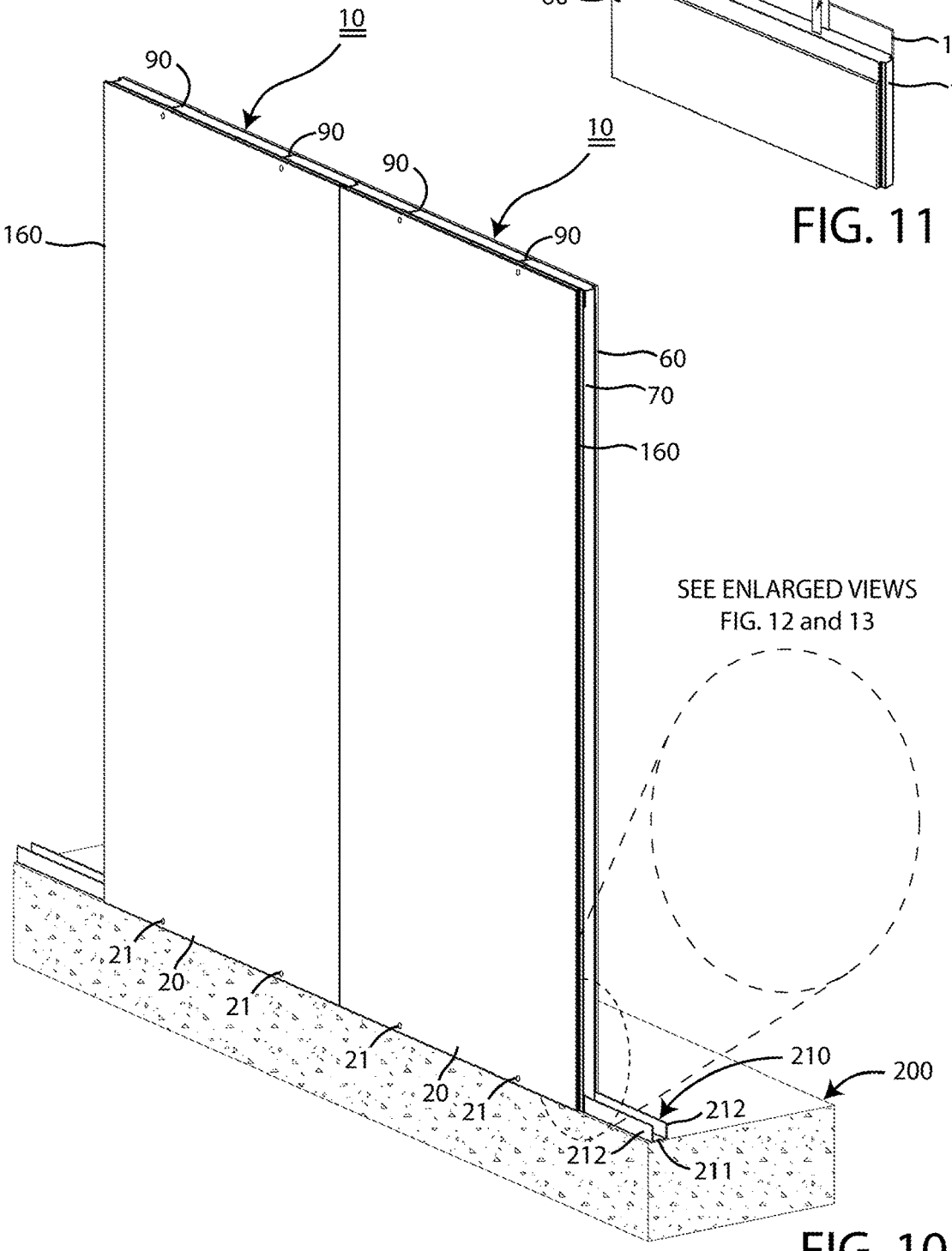
FIG. 10 shows two structural panel assemblies 10 mounted to a bottom U-channel 210 on a concrete foundation 200 with the lower section surrounded with broken lines, which can be viewed in more detail in FIGS. 12-14, showing how the bottom U-channel 210 interfaces with the structural members 90.

FIG. 10 show a pair of wall panels 10, like those shown in FIGS. 9A to 9D, which have been cam-locked together and mounted to a bottom U-channel 210 located on a concrete foundation 200. FIG. 11 is a closeup of the top end of the wall panel 10 with an upper portion of the substrate 60 and some of the foam core 70 removed to show how the structural members 90 extend through the foam core 70 in parallel with the substrate 60 and additional cladding layer 160. This allows for a direct metal to metal connection between the metal studs 90 that are "floating" inside of the wall panels 10 and the metal framing that is both below and above the walls, provided at least in part by the bottom-connecting U-channel 212, to mechanically provide for a structural load bearing connection, while also connecting adjacent walls together.

Figure 12:
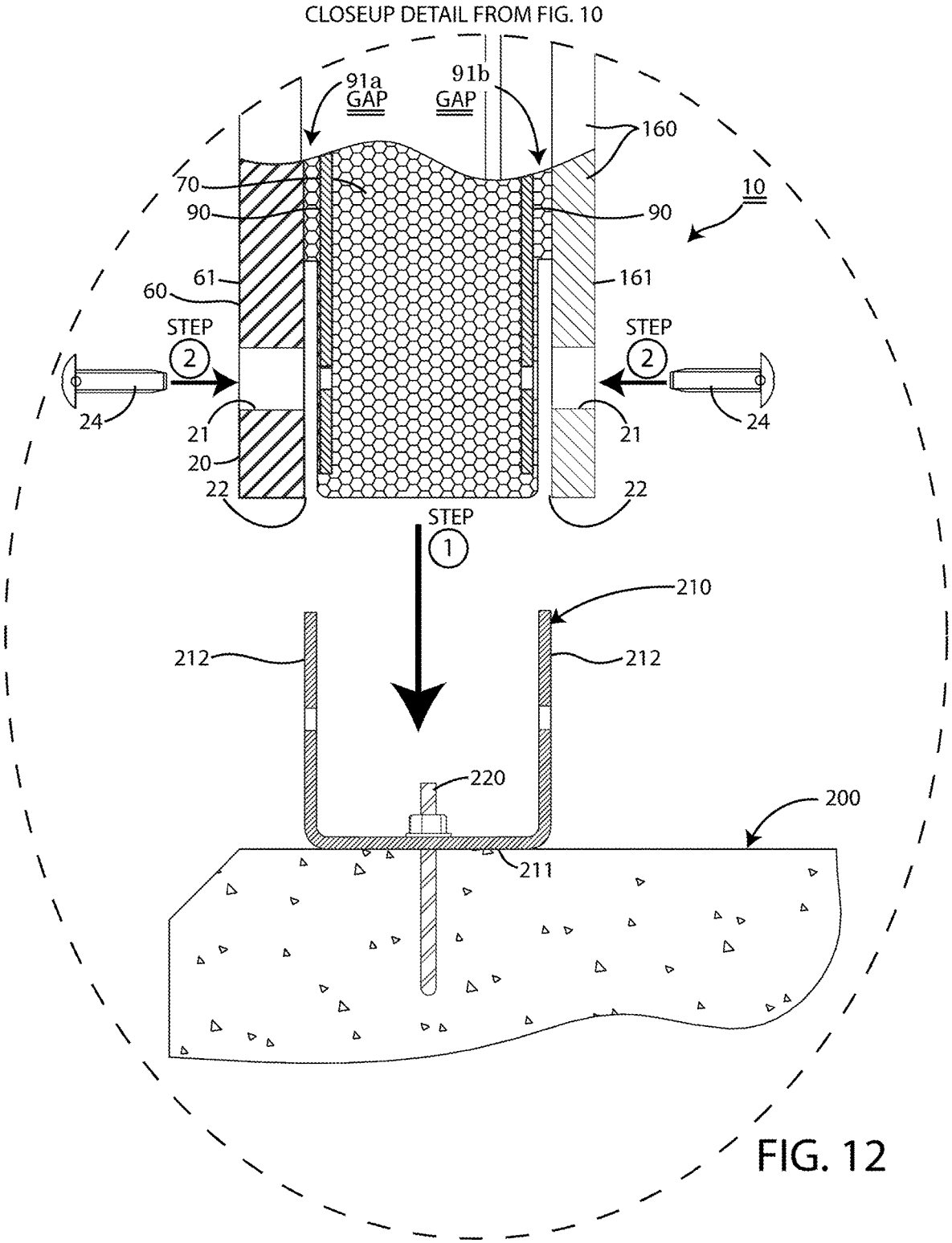
FIGS. 12 and 13 show in cross-section how the structural panel assembly 10 is connected to the foundation 200 at the base, where, in particular.
Figure 13:
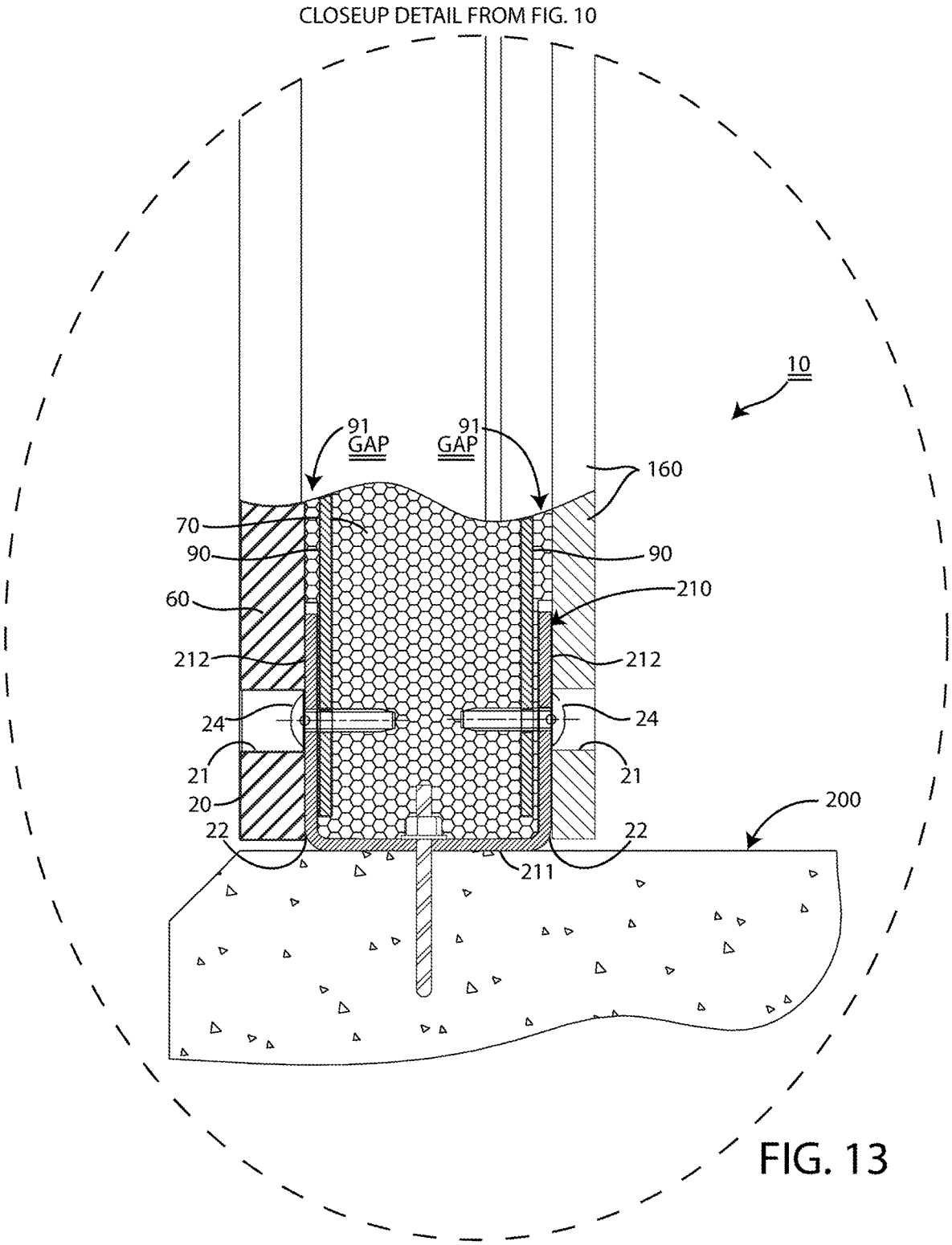

FIGS. 12 and 13 show elongated mounting slots 22 at the bottom end 20 of the wall panel 10 which uniquely allow the wall panel 10 to be dropped down onto the vertical walls 212 of the "bottom-connecting U-channel" 210 that was previously secured to the concrete foundation 200 in order to structurally connect together adjacent wall panels 10, 10. As shown after the wall panel 10 has been positioned downward onto the bottom-connecting U-channel 210 (step 1), a pair of fasteners 24 are installed via preferably pre-formed apertures 21 to directly connect a bottom end of the wall panel's structural member 90 to the bottom-connecting U-channel 210 (step 2).

Figure 14:
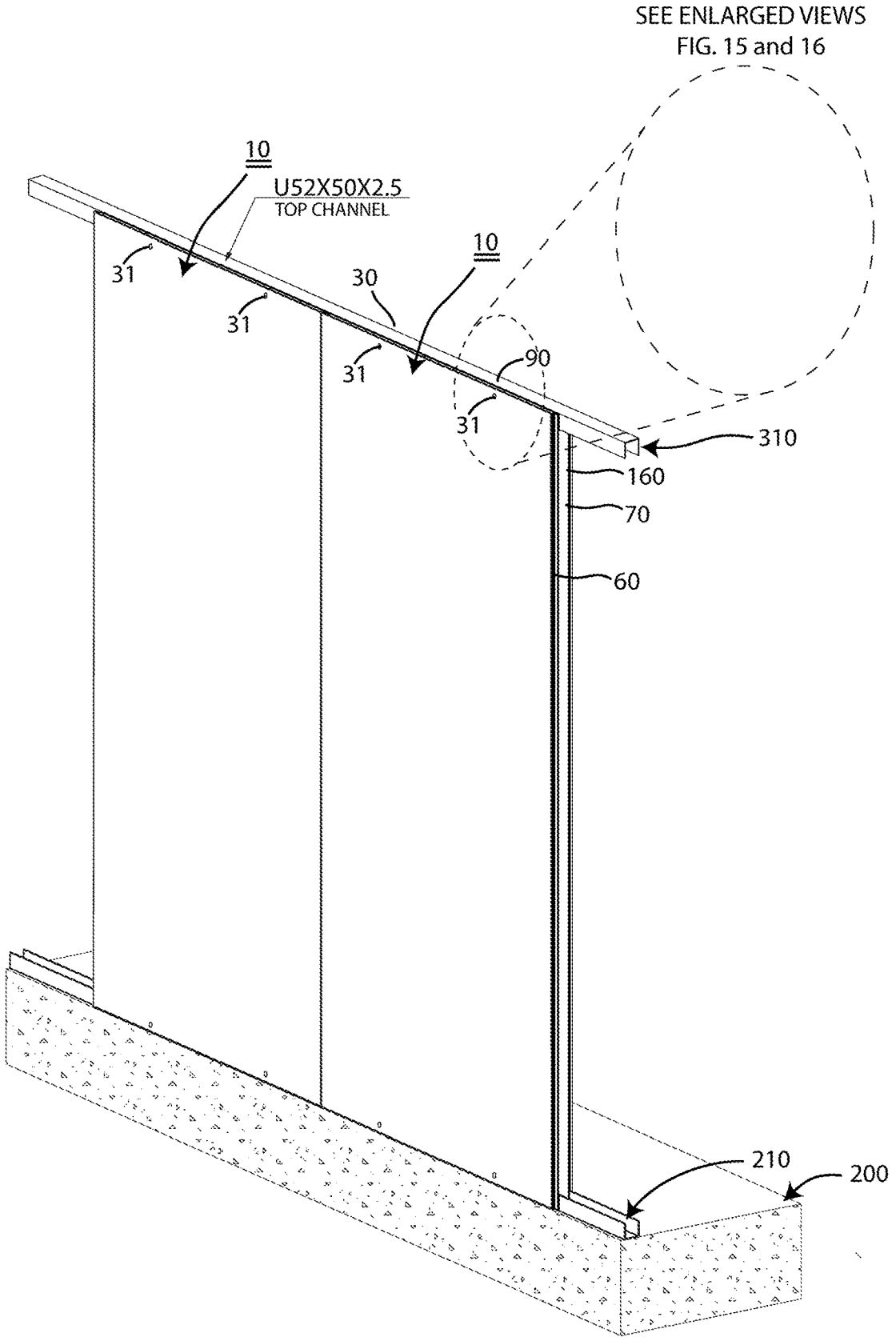
FIGS. 14-18 show how the structural panel assembly 10 is connected to further structure at the top where, in particular.
Figure 15:
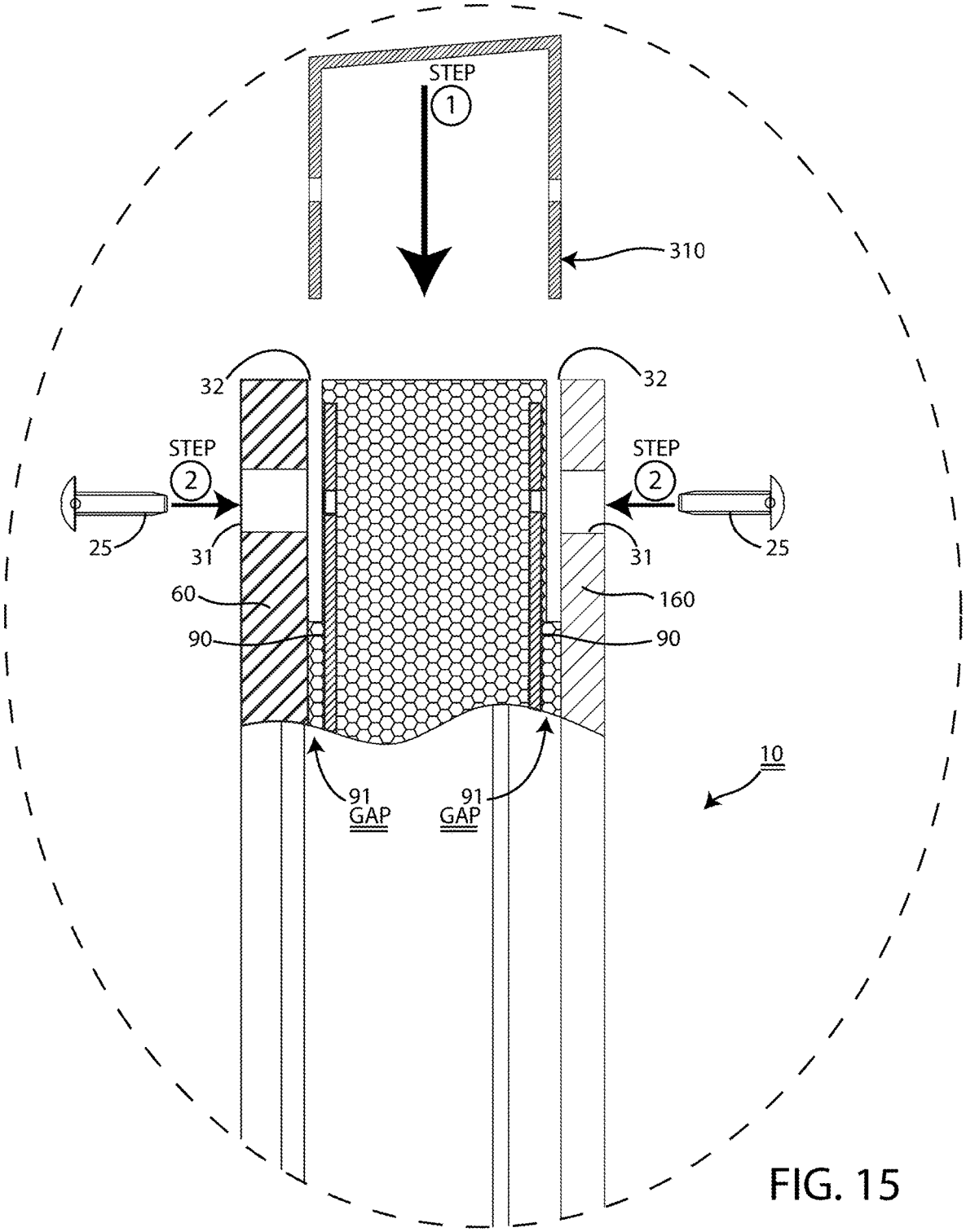
Figure 16:
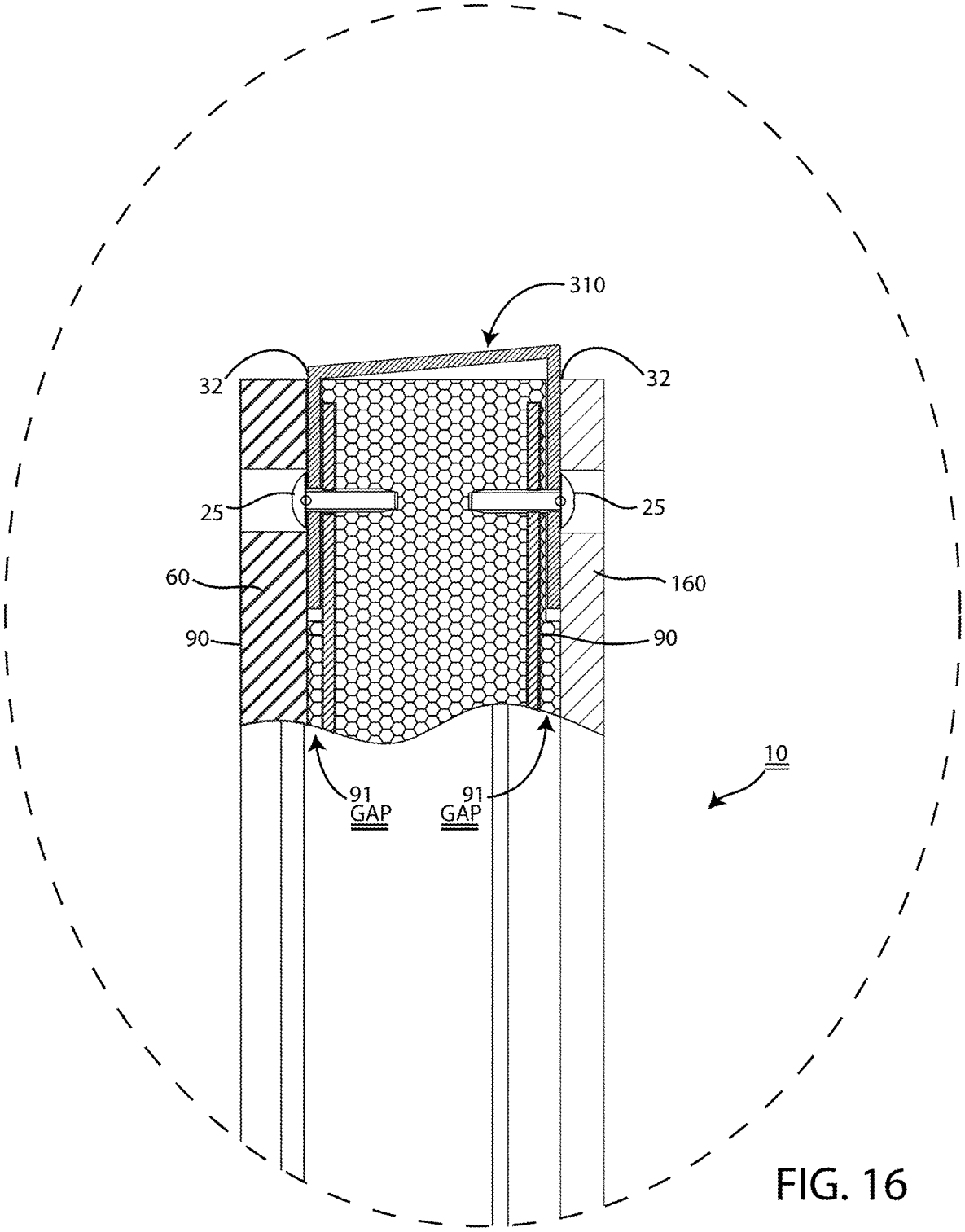

FIG. 14 shows an angled top channel 310 mounted to the wall panel 10 for use in connecting together adjacent wall panels 10, 10, and supporting a roof panel. FIGS. 15 and 16 show how the angled top channel 310 is dropped into the elongated mounting slots 32 at the top end 30 of the wall panel 10 (step 1). Then, after the angled top channel 310 is positioned, a pair of fasteners 25 are installed via pre-formed apertures 31 (step 2) to directly connect the angled top channel 310 to a top end of the wall panel's structural member 90.

Figure 17:
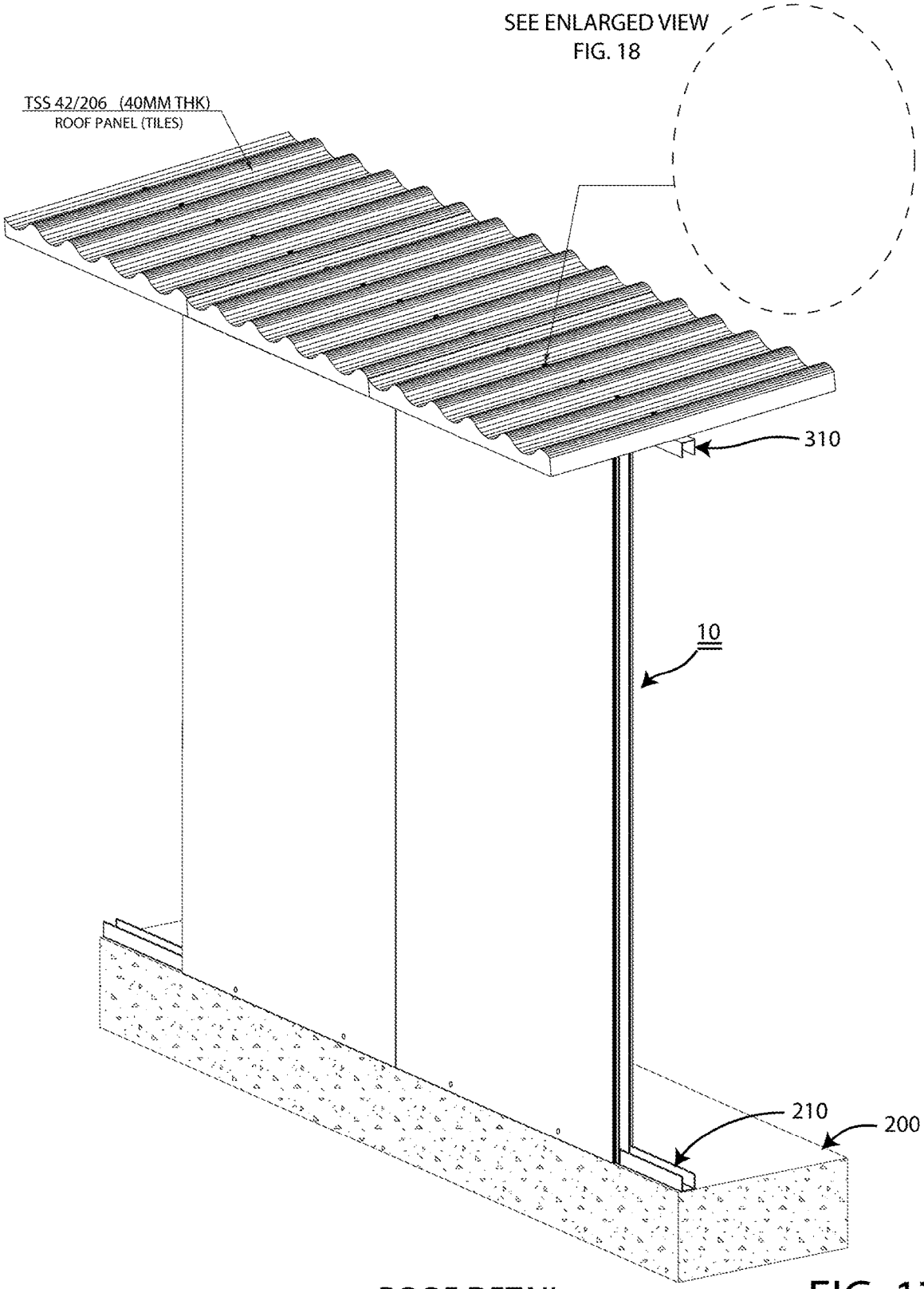
Figure 18:
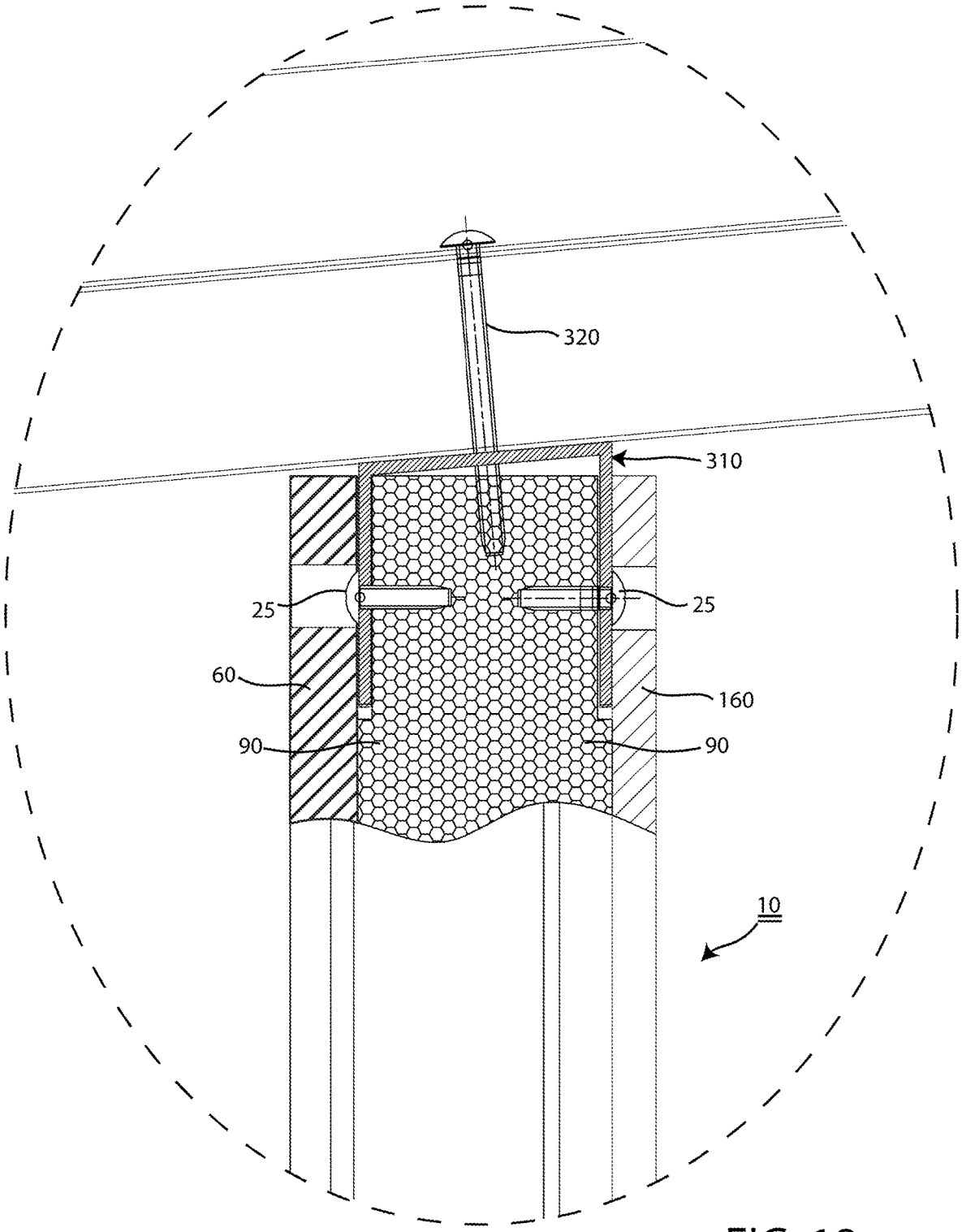

FIGS. 17 and 18 should be viewed together. FIG. 17 shows how a roof panel is connected to the angled top channel 310. In particular, as best shown in FIG. 18 which is a close-up cross-section of the top of the structure shown, a fastener 24 is installed through the roof panel so that it is structurally connected it to the top channel 310 which, in turn, is structurally connected to the structural member 90 which, as shown in FIG. 14, is structurally connected to the bottom bracket 210. The top and bottom U-channels 210, 310, assisted by the cam-locks, also provide for the structural connection of the modular wall panel assemblies 10, 10 to each other.

Further Developed System

Figure 19:
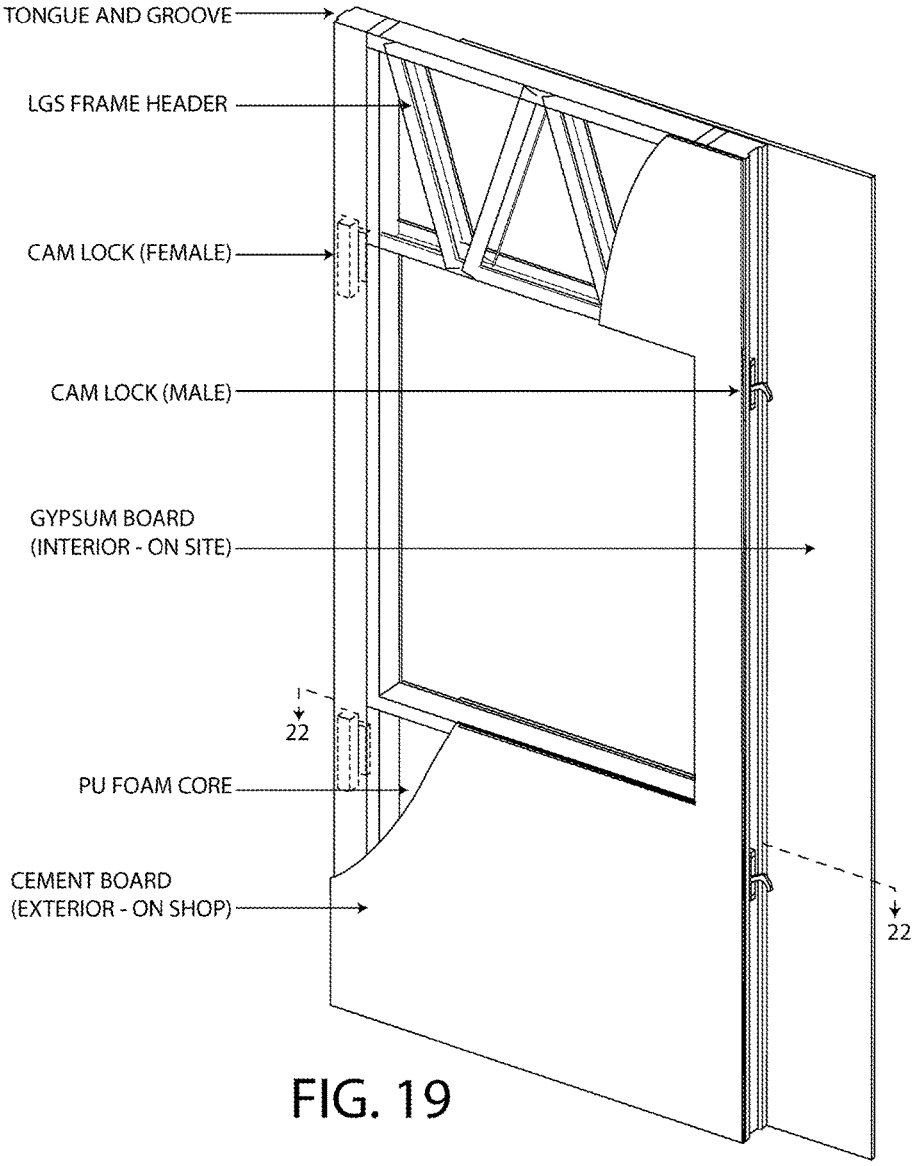
FIGS. 19 and 20 are perspective and cross-sectional views, respectively, of a structural panel assembly where the substrate used to fabricate the panel "on shop" is cement board and the interior is finished "on site" with gypsum board panels.
Figure 20:
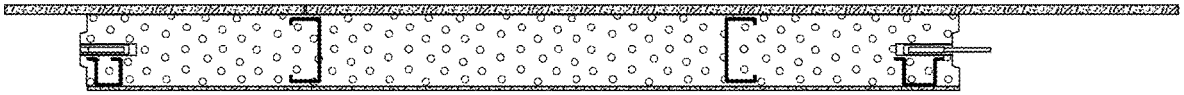

FIGS. 19 and 20 are perspective and cross-sectional views, respectively, of a standard wall panel. Here, the substrate (not numbered) used to fabricate the panel "on shop" is cement board and the interior is finished "on site" with gypsum board panels. An added feature is the further inclusion of LGS members which are located adjacent to the cement panel for allowing an earthquake strap to be secured thereto.

Figure 22:
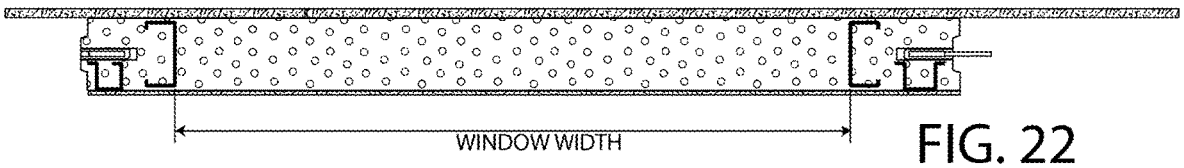
FIGS. 21 and 22 are perspective and cross-sectional views, respectively, of a wall panel assembly with a window opening.
Figure 21:
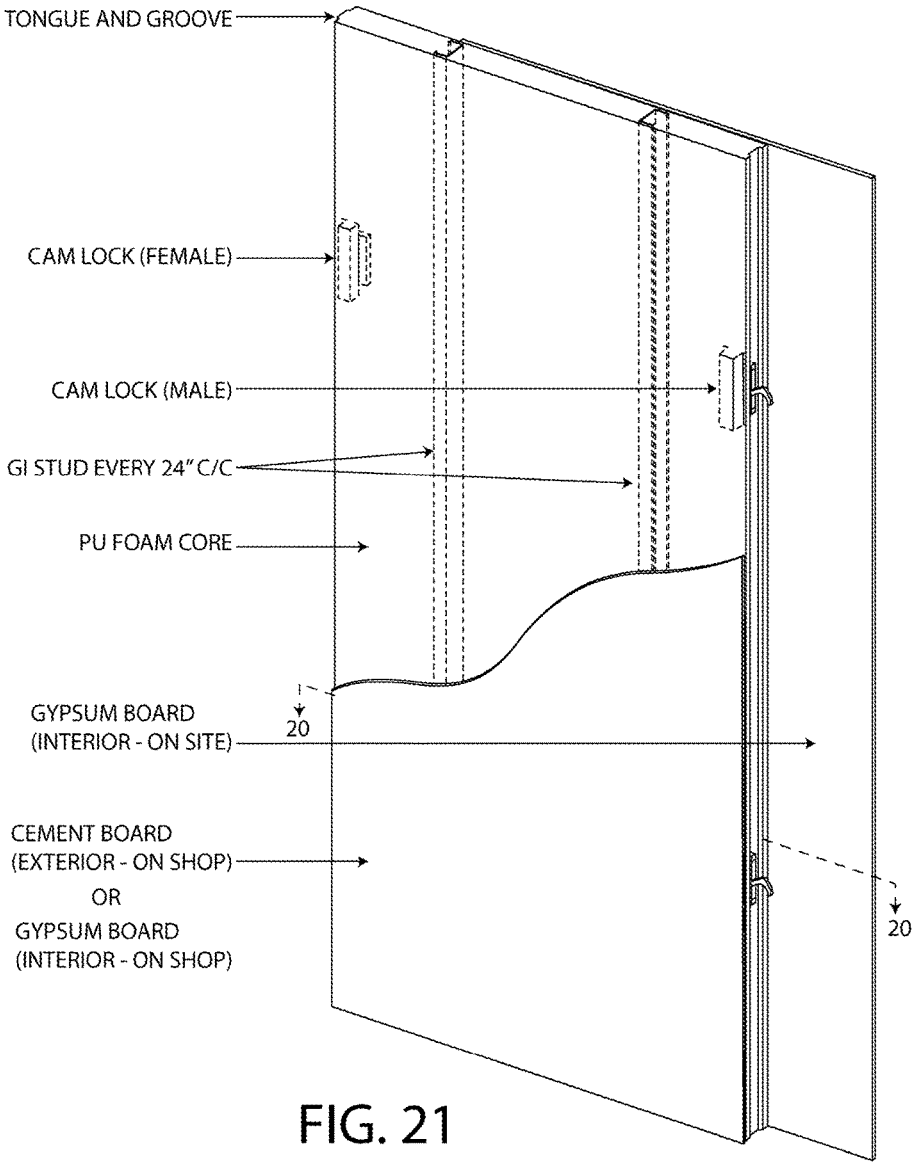

FIGS. 21 and 22 are perspective and cross-sectional views, respectively, of a standard wall panel with a window opening.

Figure 23:
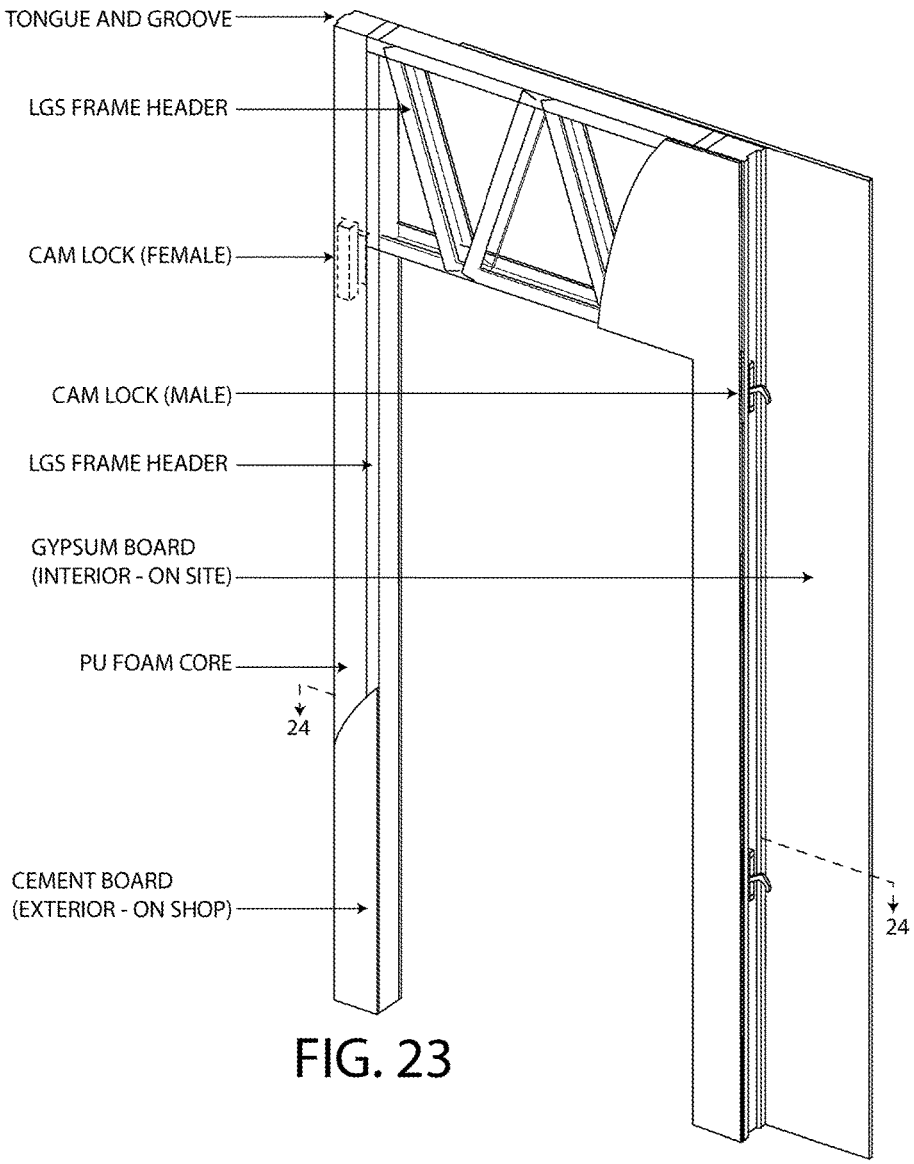
FIGS. 23 and 24 are perspective and cross-sectional views, respectively, of a wall panel assembly with a door opening.
Figure 24:
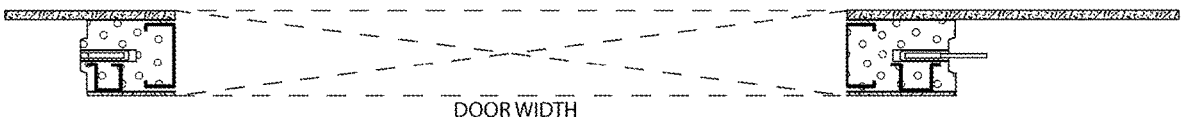

FIGS. 23 and 24 are perspective and cross-sectional views, respectively, of a standard wall panel with a door opening.

Figure 25:
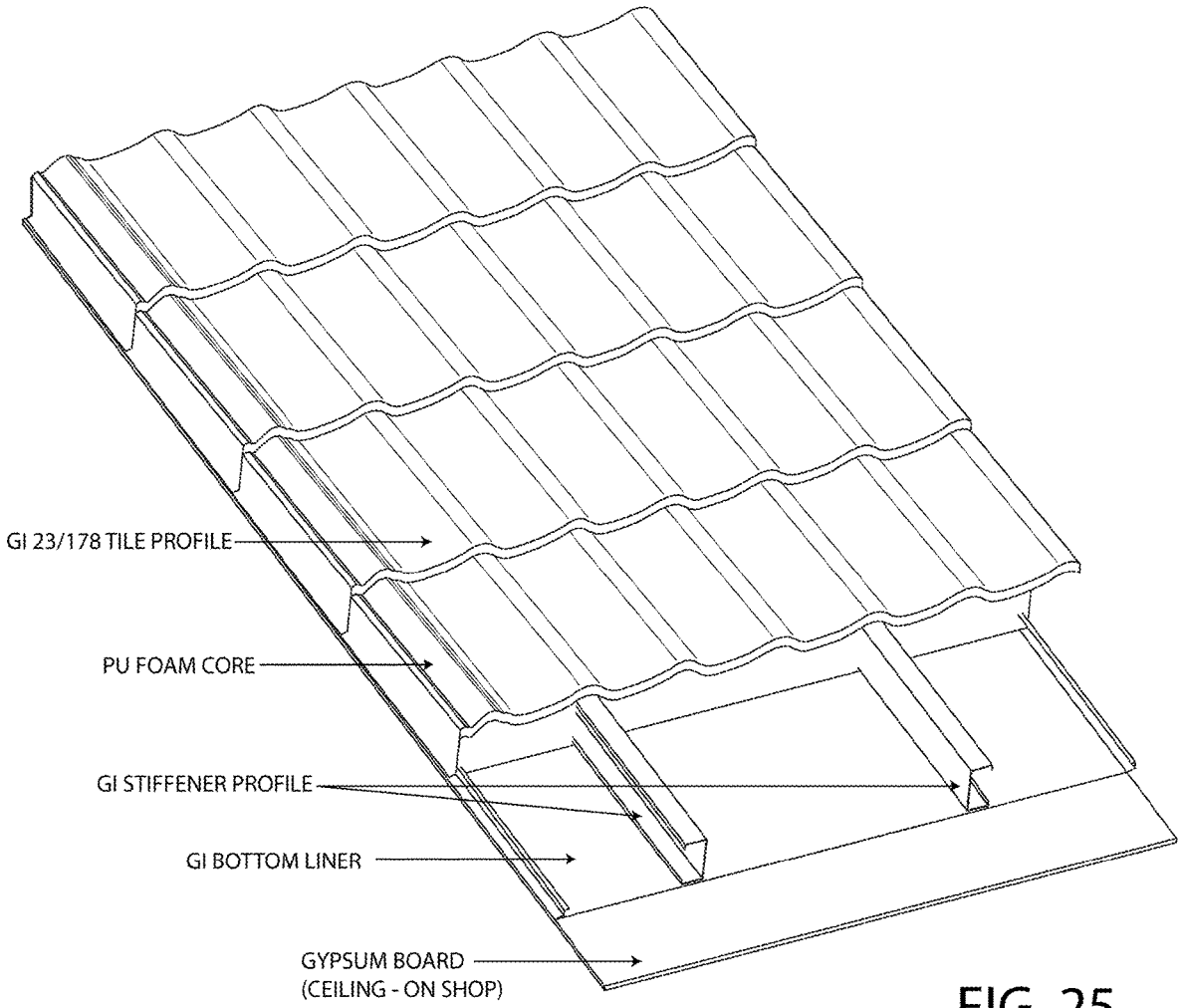
FIGS. 25 and 26 are perspective and cross-sectional views, respectively, of a roof panel assembly.
Figure 26:
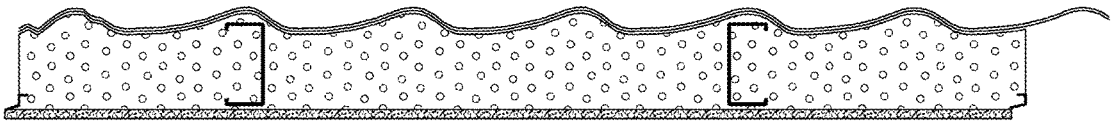

FIGS. 25 and 26 are perspective and cross-sectional views, respectively, of a standard roof panel. The roof panel assemblies also have structural members inside of them in similar fashion to the wall panel assemblies to allow for wide spans and internal connections to metal braces and the U channel on top of the walls for a structural connection, all while ensuring a thermal barrier is presented in the roof so heat does not conduct through the metal roof interior studs.

Figure 27:
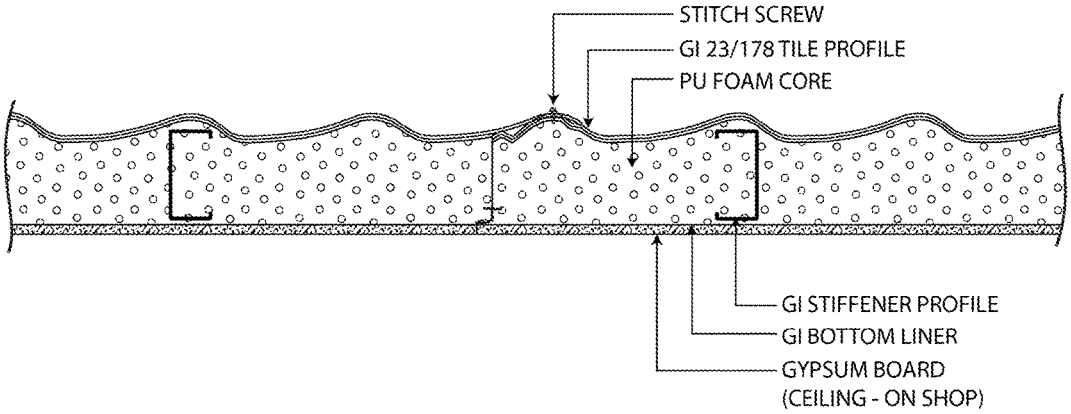
FIGS. 27 and 28 show a roof to roof panel side lap fixing, i.e. shingling.
Figure 28:
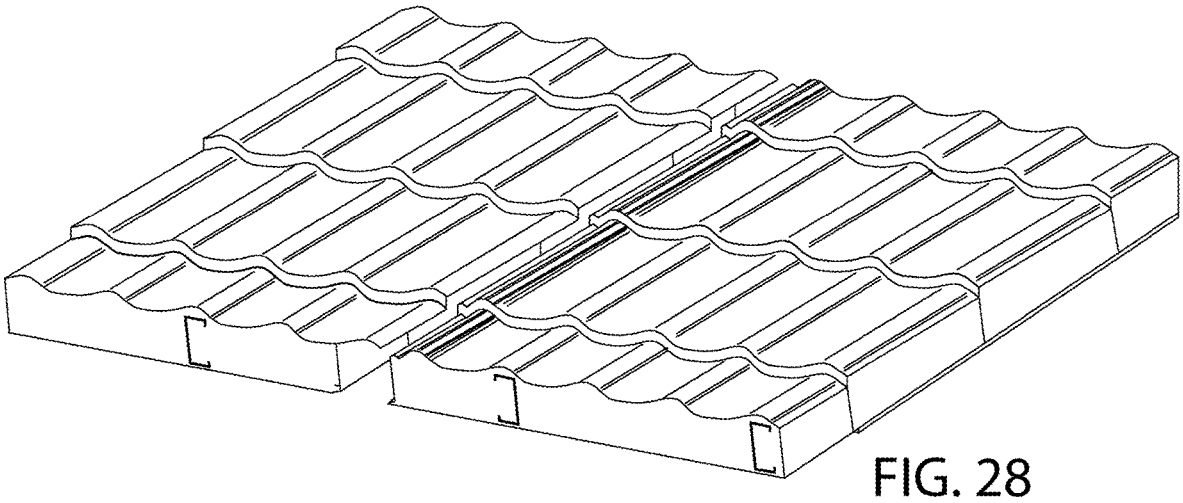

FIGS. 27 and 28 show a roof to roof panel side lap fixing.

Third Alternative Embodiment Suitable for Multi-Story Construction

The wall panel assemblies 10 discussed above include two structural members 90 (e.g. LGS studs) that are spaced from the left and right end of the wall panel assemblies. In other embodiments, however, the wall panel assemblies may be rigidified and strengthened from three LGS studs, i.e. with two at each end and with one located in the middle. The LGS studs at each end make the overall panel stronger and, because they are placed near to or even in contact with the LGS studs of adjacent wall panels when cam-locked together, effectively double up the thickness and strength of the support in that location. Such wall panel assemblies may be more suitable for multi-story constructions.

Moreover, the wall panel assemblies may be structurally reinforced between structural members with diagonal or horizontal members. The diagonal and horizontal reinforcement members embedded in the wall panels would ordinarily be hidden in the panels and not visible from the exterior. There are embodiments, however, where the studs and reinforcing members may be purposely exposed on an interior surface prior to an onsite application of gypsum board or other cladding material as discussed below.

Single Side Offset

Figure 29:
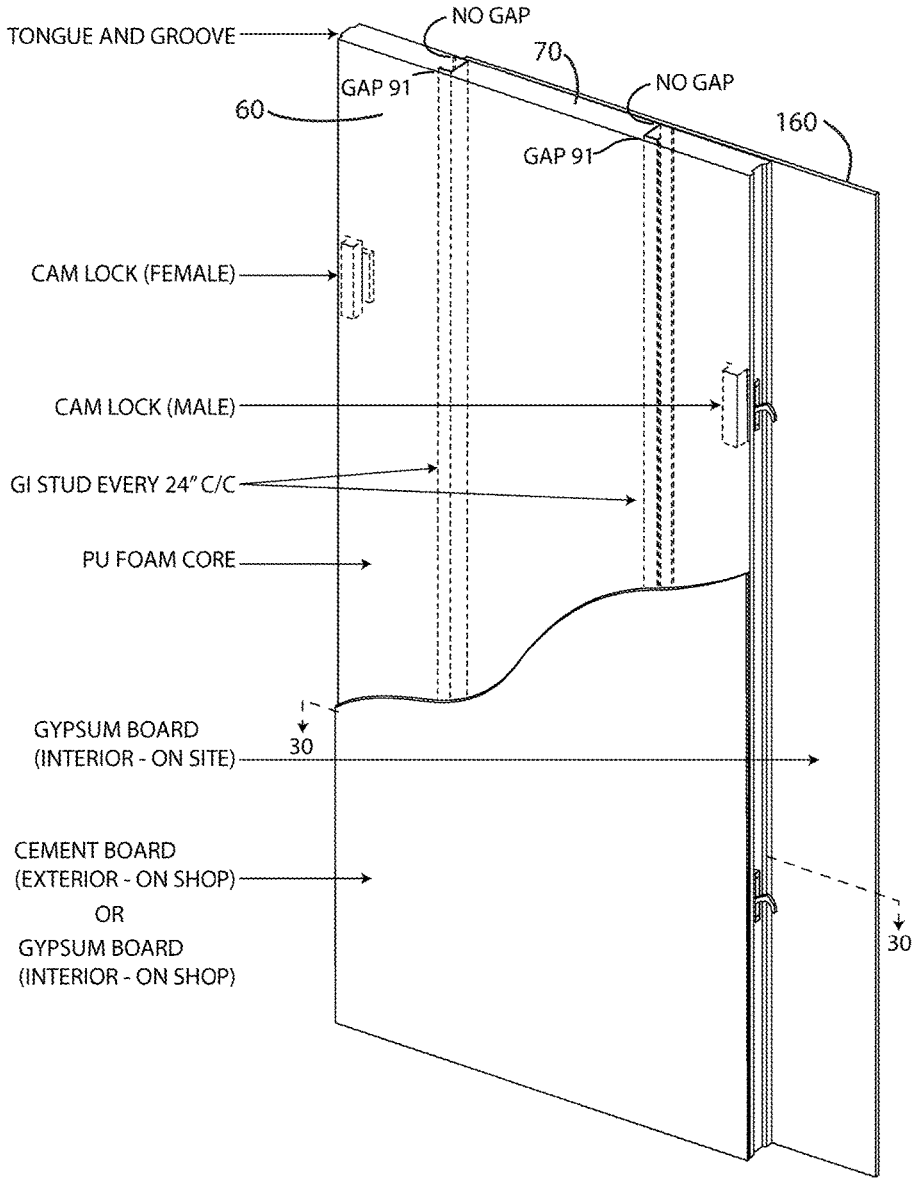
FIGS. 29 and 30 show a structural panel assembly with a single side offset.
Figure 30:
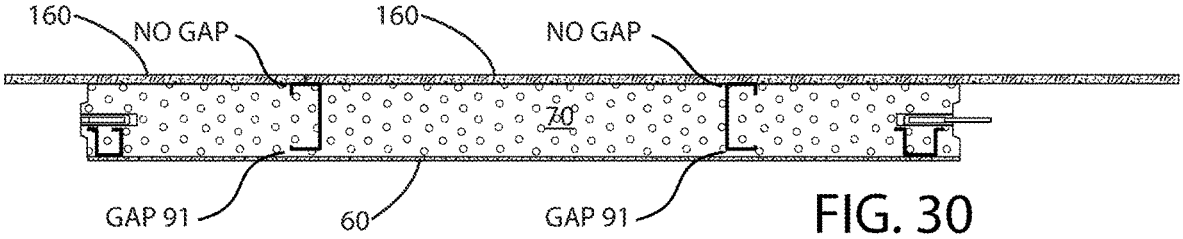

The inventor understands that some municipalities or inspection officials may demand to see the studs prior to them being covered by a gypsum board cladding layer 160. With that possibility in mind, FIGS. 29 and 30 illustrate a wall panel with a single side offset, i.e. where the studs are physically and thermally gapped from the substrate 60 but are manufactured so as to be intentionally flush with the surface of the core 70 on the side that will receive the additional cladding layer 160 (shown here already installed). In this embodiment, the additional cladding layers 160 are comprised of gypsum boards that are installed onsite. This would allow inspectors to observe the studs prior to the dry wall being installed which may be a required in some jurisdictions.

Other Substrate Options and Opposed Surface Materials

The preferred wall panel assembly 10 is formed with a substrate 60 comprised of cement board and an opposite side cladding layer 160 comprised of gypsum board. However, as already noted, numerous other materials can be used. For example, the substrate 60 could be formed from flat cement board, plank-style cement board, gypsum board, etc. Usually, the substrate 60 would be relatively thick and rigid for manufacturing purposes, but in theory, the substrate could also be formed from thinner, less rigid surface material (e.g. paper, foil, rolled steal, etc.). In addition, the optional second cladding layer 160 could also be formed from gypsum board, pre-textured panels, metal sheet, etc.), or other thinner, less rigid surface material (e.g. paper, foil, rolled steel, etc.), or absent altogether such that the core 70 is exposed until it is covered on-site.

Figure 31:
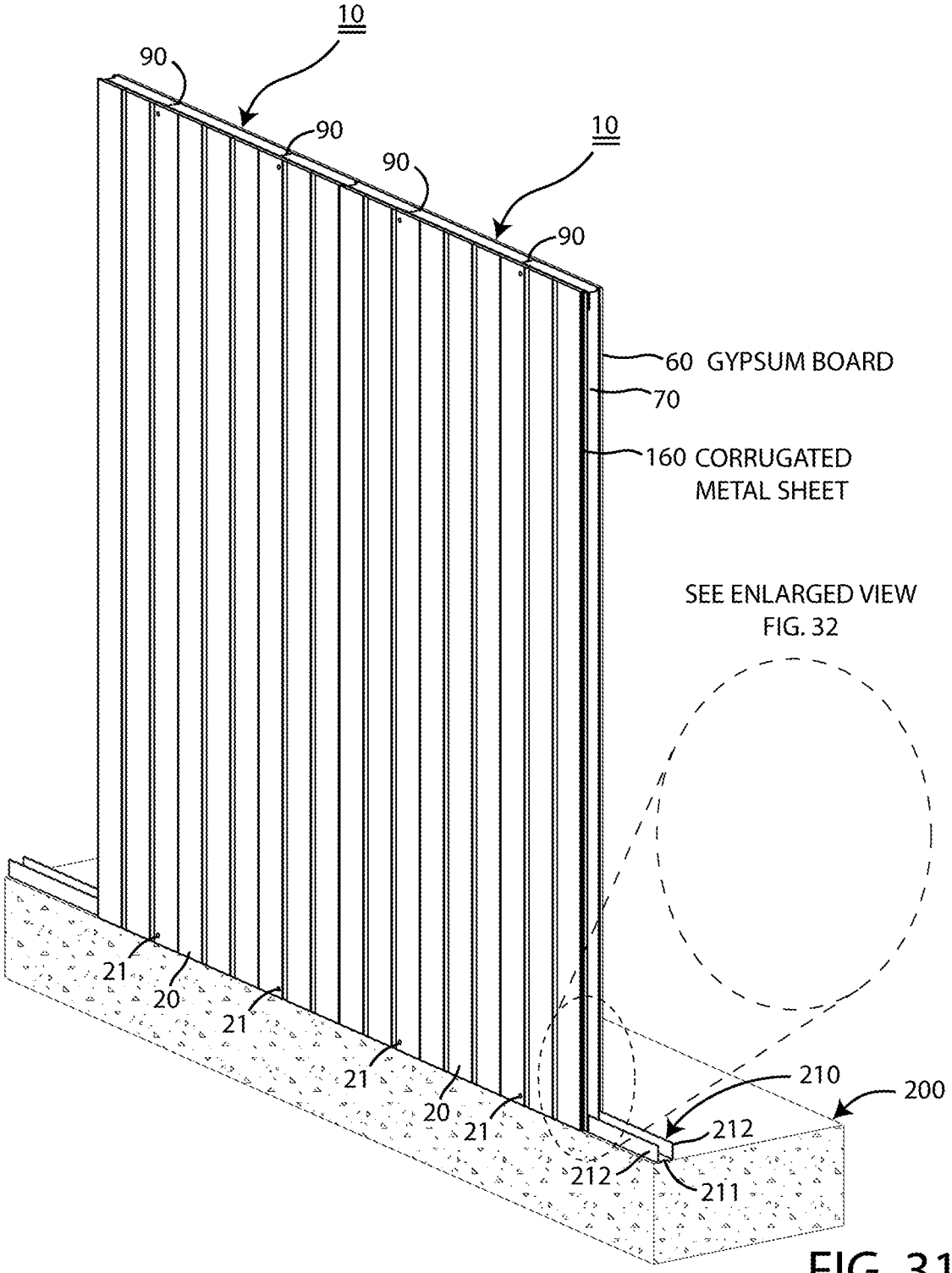
FIGS. 31 and 32 show a structural panel assembly of alternative construction where the substrate 60 is formed from gypsum board and the opposing surface cladding layer 160 is formed from corrugated metal sheet.
Figure 32:
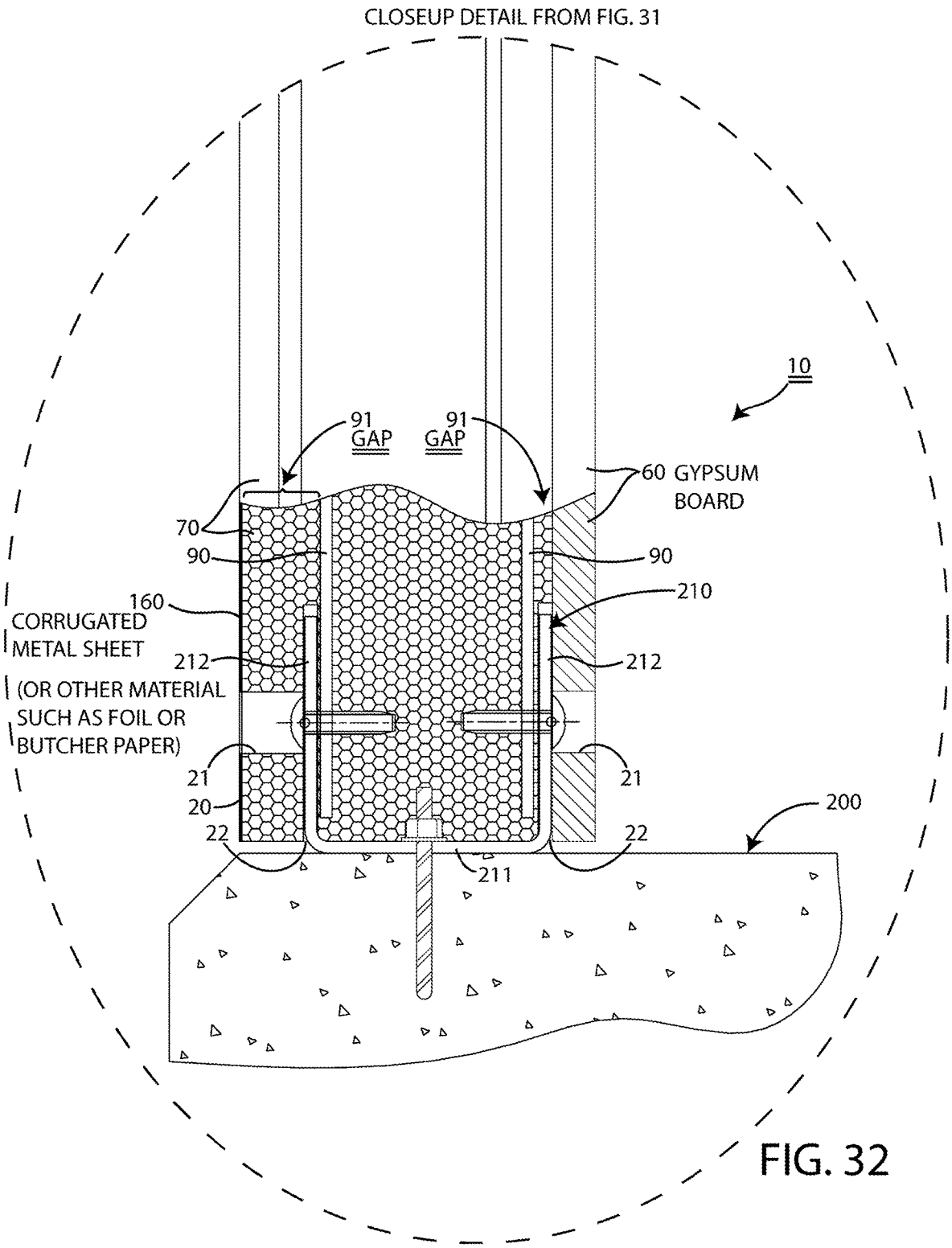

With this in mind, FIGS. 31 and 32 illustrate one example of such an alternative construction. Here, the substrate 60 is formed from gypsum board and the opposing cladding layer 160 is formed from corrugated metal sheet. In this particular arrangement, the wall panel assembly 10 would be positioned on-site with the gypsum board substrate 60 on the interior side as shown in FIG. 31. As before, however, the construction uniquely provides for thermal gaps between the structural members and one or more of the surface treatments. In this case, the gaps 91 are on both sides and the gap 91 between the structural member 90 and the corrugated steel sheet cladding layer 160 is thicker than would be the case with a wall panel assembly that had a thicker cladding such as cement board.

Alternative Bottom U-Channel Member

FIGS. 2, 3, 12, 13, and 14 show a bottom U-channel member 210 with vertical side walls 212, 212 that fit into mounting slots 22 at the bottom of the structural panel assembly, slots 22, 22 that are conveniently formed in the gaps 91, 91 formed between the LGS stud 90 and the substrate 60 and other cladding material 160.

Figure 33:
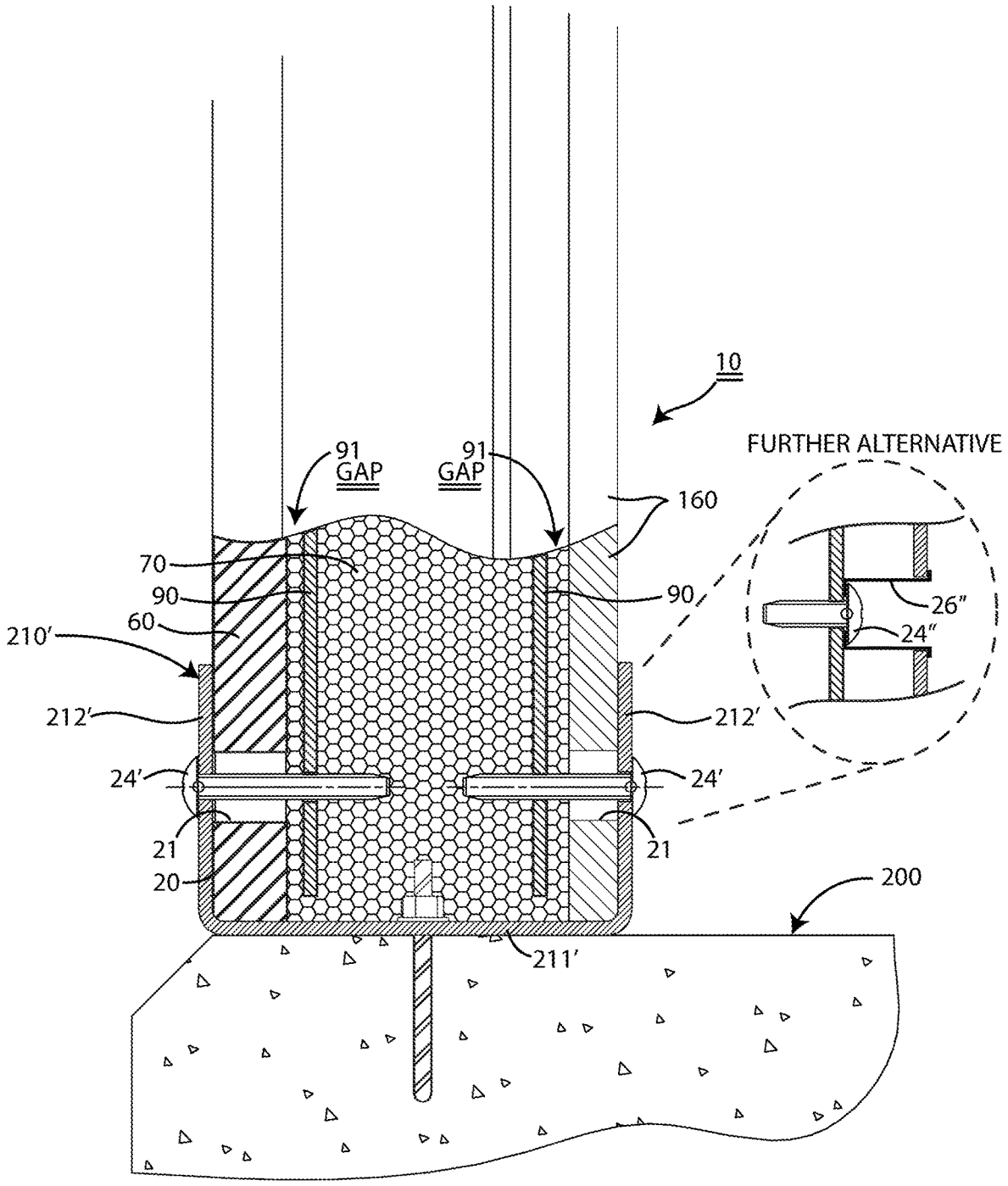
FIG. 33 shows in cross-section how the structural panel assembly 10 may be connected to the foundation 200 with an alternative bottom U-channel 210' that having a flat bottom wall 211', and two vertical side walls 212', 212' that are on the outside of the panel assembly 10.

FIG. 33 shows in cross-section how the top or bottom U-channel 210, 310 may be modified to surround the structural panel assembly 10. Here, focusing on the bottom, the structural panel assembly 10 may still feature gaps 91, 91, but be connected to the foundation 200 with an alternative bottom U-channel 210' that fits on the outside of the panel assembly 10. The alternative bottom U-channel 210' has a flat bottom wall 211', and two vertical side walls 212', 212', the side walls 212' being spaced apart as required. Here, longer fasteners 24' are used.

FIG. 33 shows the U-channel 210' with apertures that fit the shaft of the fasteners 24. It may be desirable, however, to provide the alternative U-channel 210' with apertures that are wider than the heads of fasteners 24' so that the heads are recessed beneath the vertical plane of the side walls 212', 212'. In such case, as suggested by the oval inset with broken lines, a drop-in fastener seat 26" may also be used in conjunction with a shorter fastener 24", the seat having an annular outer flange that attaches to the side wall 212', and an apertured depression that fits within the pre-drilled apertures 21, 21 and receives the head of the fastener 24'. The seat may also have a depth that provides a far end that presses against the LGS stud 90, effectively allowing the seat to be sandwiched between the side wall 212 and the LGS stud 90. The fastener seat 26" may be filled onsite with suitable wall compound if desired.

Method of Manufacturer

The inventor contemplates two different methods of manufacturing structural panel assemblies and other related components.

Discontinuous Press Method

A simple production system is to have a large press cavity with four sides closed in which one or multiple substrates are placed (e.g. 4×8 cement board panels). It can vary, but a press arrangement contemplated of this nature could create one panel at a time, or it could use a vertically stacked arrangement or horizontally extended arrangement to process multiple panels at the same time. Then, LGS studs 90 are placed on top of the substrates while using thin spacers or shims that gap the LGS studs 90 slightly away from the substrates. The camlocks are placed at the ends of the panels, on the substrate, with a suitable attachment mechanism. Then polyurethane or other suitable filling material is applied through apertures in the side walls to reach the arrangement of substrates, shims, and LGS studs, the polyurethane making extensive contact with the substrates and capable of flowing around, between, under and over the LGS studs as it expands. Next, a top layer of just paper, or factory-installed gypsum board panels if desired, is placed prior to closing the top of the press for the required curing time. Then the press is opened and the panels are removed. An alternative version of the above processes can be to use gypsum board or other cladding material as the substrate (instead of the cement board) and to use coated steel instead of paper and/or gypsum board on the upper surface.

Continuous Press Method

The presently preferred method of manufacturing the wall panels 10 is a large continuous production system that is about 300 feet long. At the input end of the process, a succession of substrates (item 60 in the above figures) are laid onto a conveyor (e.g. 4×8 cement board panels). Next, LGS studs 90 are laid across each cement board panel 60, on top of thin spacers or shims that gap the LGS studs 90 slightly away from the cement board panel 60, and then the studs 90 are lightly secured to the cement board panel 60 with glue or short tack screws that do not exit the other side. Next, with the sides of the assembly constrained to prevent spreading, polyurethane is sprayed over the gypsum panel/LGB stud assemblies so that it begins to expand. Next, a 4×8 gypsum board is placed on top or a roll of paper or a steel coil is rolled out over the top, and then the CB panel/LGB stud assemblies are compressed between upper and lower tractor drives with a desired surface topography to cure. After a suitable curing time, the moving assemblies are cut by a cross-saw mechanism that advances with the assembly line during the cutting and then returns to a start position for the next cut. Finally, the cut panels 10 are stacked up, and workers use hand tools to manually cut in the U-channel grooves 22, 32 on the top and bottom edges of each panel to expose the LGS studs 90 for connection to other system elements. The cement boards or alternative face material can also be fed into the laminator with studs pre-attached to the cement board before feeding or even in a framed jig set to hold everything in desired place.

There are many possible assembly options. Two exemplary options are: (1) Cement Board exterior—On the bottom is the exterior cement board and on the top is the paper. The metal studs are attached to the bottom cement board on the continuous line. The paper covers the top as the polyurethane expands. Once the panel comes off the line, the interior drywall is screwed onto the paper side or installed on-site. (2) Steel exterior—On the bottom is the interior drywall (e.g. gypsum board) with the metal studs attached to it. In this case on top will be the steel that is rolled onto it.

I claim:

1. A structural panel assembly of rectangular parallelepiped shape that is substantially taller and wider than thick, the structural panel assembly having a first broad side, a second broad side, a bottom end, a top end, a left end, and a right end, the structural panel assembly adapted for use in a structural panel building system, the structural panel assembly comprising:

a first substrate of sheet material forming the first broad side of the structural panel assembly, the first substrate having an inner face and an outer face;

a second substrate of sheet material forming the second broad side of the structural panel assembly, the second substrate having an inner face and an outer face, the second substrate spaced from the first substrate to define a distance between the inner face of the first substrate and the inner face of the second substrate;

at least one metal stud having an elongated configuration and external surfaces, the at least one metal stud extending vertically between the bottom and top ends of the structural panel assembly, positioned in parallel with the first and second substrates, and located adjacent to but spaced from the inner face of the first substrate and the inner face of the second substrate, the at least one metal stud having a width transverse to the elongated configuration that substantially spans the distance between the inner faces of the first and second substrates;

a first gap formed between the inner face of the first substrate and the at least one metal stud due to the at least one metal stud being located adjacent to but spaced from the inner face of the first substrate, to prevent the inner face of the first substrate from making thermal contact with the at least one metal stud and thereby provide the structural panel assembly with increased thermal insulation capability;

an adhesive filling material located between the first substrate of sheet material and the second substrate of sheet material and adhesively embedding the at least one metal stud, the adhesive filling material making adhesive contact with the external surfaces of the at least one metal stud embedded therein, the inner face of the first substrate of sheet material, and the inner face of the second substrate of sheet material, wherein the at least one metal stud, the first substrate, and second substrate are glued together as a unit by the adhesive filing material without the use of mechanical fasteners, the adhesive filling material further occupying the first gap and making further adhesive contact therein with the inner face of the first substrate and the at least one metal stud, to adhesively hold together the first substrate of sheet material, the second substrate of sheet material, the at least one metal stud, and the adhesive filling material; and a first bottom mounting slot extending along a bottom end of the structural panel assembly and vertically upward to a bottom mounting slot depth, the first bottom mounting slot formed by the absence of adhesive filling material in the first gap between the first substrate and the at least one metal stud at the bottom end of the structural panel assembly, and a first top mounting slot extending along a top end of the structural panel assembly to and vertically downward to a top mounting slot depth, the first top mounting slot formed by the absence of adhesive filling material in the first gap between the first substrate and the at least one metal stud at the top end of the structural panel assembly, the first bottom and first top mounting slots exposing a bottom and top end, respectively, of the at least one metal stud for structural connection of the bottom and top ends of the structural panel assembly.

2. The structural panel assembly of claim 1 wherein the at least one metal stud has a central section and first and second perpendicular side sections extending therefrom that form a U-shaped profile.

3. The structural panel assembly of claim 1 wherein the at least one metal stud has a U-shaped, C-shaped, L-shaped, Sigma-shaped, or Z-shaped profile.

4. The structural panel assembly of claim 1 further comprising a plurality of shims that create the first gap between the first substrate and the at least one metal stud, the shims being positioned on the inner surface of the first substrate, beneath the at least one metal stud.

5. The structural panel assembly of claim 1 wherein the first bottom mounting slot is adapted to receive a bottom mounting member with a first extension that fits into the bottom mounting slot and slides adjacent to the at least one metal stud and connects the structural panel assembly to a slab located below the structural panel assembly.

6. The structural panel assembly of claim 1 wherein the first top mounting slot is adapted to receive a top mounting member with a first extension that fits into the top mounting slot and slides adjacent to the at least one metal stud and connects the structural panel assembly to additional building structure located above the structural panel assembly.

7. The structural panel assembly of claim 1 further comprising a second bottom mounting slot that is parallel to the first bottom mounting slot, the first and second bottom mounting slots forming a bottom pair of mounting slots at the bottom end of the structural panel assembly, and a second top mounting slot that is parallel to the first top mounting slot, the first and second top mounting slots forming a top pair of mounting slots formed at the top end of the structural panel assembly.

8. The structural panel assembly of claim 7 further wherein the bottom pair of mounting slots are adapted to receive a bottom channel member with first and second extensions that fit into the bottom pair of mounting slots and slide adjacent to opposite sides of the at least one metal stud; and wherein the top pair of mounting slots are adapted to receive a top channel member with first and second extensions that fit into the top pair of mounting slots and slide adjacent to opposite sides of the at least one metal stud.

9. The structural panel assembly of claim 8 further comprising a plurality of blind apertures formed in the first broad side and the second broad side of the structural panel assembly, near the top and bottom ends of the structural panel assembly, respectively, the plurality of blind apertures adapted to permit mechanical fasteners to be inserted through the first and second extensions of the channel member and then into the opposite sides of the at least one metal stud to securely connect the first and second extensions of the channel member to the at least one metal stud.

10. The structural panel assembly of claim 1 wherein the adhesive filling material forms an insulating core that provides the structural panel assembly with increased thermal insulation capability.

11. The structural panel assembly of claim 1 wherein the adhesive filling material is foamed polyurethane.

12. The structural panel assembly of claim 1 wherein the filing material is expanded polystyrene (EPS).

13. The structural panel assembly of claim 1 wherein the adhesive filling material is foamed polyisocyanurate (PIR).

14. The structural panel assembly of claim 1 further comprising a plurality of shims that create the first gap between the inner surface of the first substrate and the at least one metal stud, the shims being positioned on the inner surface of the first substrate, beneath the at least one metal stud, the adhesive filling material being formed onto the inner face of the first substrate and around the at least one metal stud, into the first gap created between the first substrate and the at least one metal stud, the adhesive filling material thereby making continuing to make adhesive contact with the inner face of the first substrate, the inner face of the second substrate, and the at least one metal stud.

15. The structural panel assembly of claim 1 wherein the structural panel assembly is a wall panel.

16. The structural panel assembly of claim 1 further comprising male cam locks on the left end of the structural panel assembly and female cam locks on the right end the structural panel assembly so that the structural panel assembly is adapted to interconnect with other structural panel assemblies of the same construction.

17. The structural panel assembly of claim 1 wherein the at least one metal stud is formed from lightweight galvanized steel (LGS).

18. The structural panel assembly of claim 1 wherein the at least one metal stud comprises first and second elongated metal studs that are positioned in parallel with but spaced away from the left and right ends of the structural panel assembly.

19. The structural panel assembly of claim 1 wherein the first substrate is flat.

20. The structural panel assembly of claim 19 wherein the first substrate is a cement board panel.

21. The structural panel assembly of claim 19 wherein the first substrate is a gypsum board panel.

* * * * *